US009050706B2

(12) United States Patent
Wiand et al.

(10) Patent No.: US 9,050,706 B2
(45) Date of Patent: Jun. 9, 2015

(54) SEGMENTED PROFILED WHEEL AND METHOD FOR MAKING SAME

(71) Applicant: Inland Diamond Products Company, Madison Heights, MI (US)

(72) Inventors: Ronald Wiand, Troy, MI (US); Bruce C. Baker, Troy, MI (US)

(73) Assignee: Inland Diamond Products Company, Madison Heights, MI (US)

( * ) Notice: Subject to any disclaimer, the term of this patent is extended or adjusted under 35 U.S.C. 154(b) by 178 days.

(21) Appl. No.: 13/774,090

(22) Filed: Feb. 22, 2013

(65) Prior Publication Data

US 2013/0217315 A1 Aug. 22, 2013

Related U.S. Application Data

(60) Provisional application No. 61/601,746, filed on Feb. 22, 2012.

(51) Int. Cl.

| | |
|---|---|
| ***B24D 5/06*** | (2006.01) |
| ***B24D 5/12*** | (2006.01) |
| *B24D 5/16* | (2006.01) |
| *B24D 18/00* | (2006.01) |

(52) U.S. Cl.

CPC ... *B24D 5/06* (2013.01); *B24D 5/16* (2013.01); *B24D 18/00* (2013.01); *B24D 5/12* (2013.01)

(58) Field of Classification Search

CPC ..... B24D 5/12; B24D 18/00; B24D 5/06; B24D 5/02; B24D 5/16

USPC ..... 451/541, 542, 546, 547, 548–551; 125/13.01; 51/297

See application file for complete search history.

(56) References Cited

U.S. PATENT DOCUMENTS

| | | | | | |
|---|---|---|---|---|---|
| 1,589,855 | A | * | 6/1926 | Hyde | 451/548 |
| 2,205,296 | A | * | 6/1940 | Leafe | 451/542 |
| 2,219,398 | A | * | 10/1940 | Rickard et al. | 451/543 |
| 2,307,632 | A | * | 1/1943 | Meyer | 451/548 |
| 2,879,452 | A | * | 3/1959 | Page | 361/224 |
| 3,310,916 | A | * | 3/1967 | Nussbaum-Christmann | 451/543 |
| 3,383,807 | A | * | 5/1968 | Miller | 451/541 |
| 3,510,993 | A | * | 5/1970 | Cook | 451/548 |
| 3,524,736 | A | * | 8/1970 | Spencer | 451/548 |
| 3,590,535 | A | * | 7/1971 | Benson et al. | 451/542 |
| 3,615,309 | A | * | 10/1971 | Dawson | 51/309 |
| 3,711,999 | A | * | 1/1973 | Held | 451/541 |
| 3,754,355 | A | * | 8/1973 | Hanchett | 451/548 |
| 3,756,796 | A | * | 9/1973 | Miller | 51/309 |
| 3,830,020 | A | * | 8/1974 | Gomi | 451/541 |

(Continued)

*Primary Examiner* — George Nguyen

(74) *Attorney, Agent, or Firm* — Warn Partners, P.C.

(57) ABSTRACT

A segmented profiled wheel for grinding a glass or non-metallic workpiece including a segmented abrasive portion formed of a plurality of abrasive segments that are attached to a core of the wheel and method for making same. The plurality of abrasive segments have a cutting surface profile and sufficient abrasive grit to contour and grind the workpiece. Terminal ends of the plurality of abrasive segments are adjacent to one another and the cutting surface profiles align to form a substantially continuous rim of profiled abrasive segments for substantially continuous contact with a workpiece while the wheel rotates. The method includes the steps of forming the plurality of abrasive segments having a metal bonding matrix using automated processes, machining a metal blank to form a core, and attaching the plurality of abrasive segments to the core by laser welding and/or brazing.

48 Claims, 11 Drawing Sheets

(56) References Cited

U.S. PATENT DOCUMENTS

| | | | | | |
|---|---|---|---|---|---|
| 3,850,590 | A * | 11/1974 | Chalkley et al. | 51/298 |
| 3,916,579 | A * | 11/1975 | Waller et al. | 451/547 |
| 4,010,583 | A * | 3/1977 | Highberg | 451/42 |
| 4,212,137 | A * | 7/1980 | Rue | 451/542 |
| 4,446,657 | A * | 5/1984 | Asaeda et al. | 451/541 |
| 4,532,019 | A * | 7/1985 | Kuromatsu | 205/663 |
| 4,685,440 | A * | 8/1987 | Owens | 125/11.03 |
| 5,079,875 | A | 1/1992 | Unno et al. | |
| 5,275,856 | A * | 1/1994 | Calhoun et al. | 428/41.1 |
| 5,495,844 | A * | 3/1996 | Kitajima et al. | 125/13.01 |
| 6,074,278 | A * | 6/2000 | Wu et al. | 451/28 |
| 6,102,789 | A * | 8/2000 | Ramanath et al. | 451/541 |
| 6,213,860 | B1 * | 4/2001 | Tunstall et al. | 451/541 |
| 6,227,188 | B1 * | 5/2001 | Tankala et al. | 125/13.01 |
| 6,394,888 | B1 * | 5/2002 | Matsumoto et al. | 451/548 |
| 6,641,473 | B2 | 11/2003 | Nakagawa et al. | |
| 6,840,851 | B1 * | 1/2005 | Raffaelli | 451/547 |
| 6,846,233 | B2 * | 1/2005 | Nonogawa et al. | 451/542 |
| 8,182,318 | B2 * | 5/2012 | Soma et al. | 451/542 |
| 8,360,046 | B2 * | 1/2013 | Kim et al. | 125/15 |
| 2001/0018324 | A1 * | 8/2001 | Ito | 451/542 |
| 2002/0119742 | A1 * | 8/2002 | Nakagawa et al. | 451/542 |
| 2003/0032384 | A1 * | 2/2003 | Terada | 451/541 |
| 2007/0151554 | A1 * | 7/2007 | Song et al. | 125/15 |
| 2008/0299884 | A1 * | 12/2008 | Moroto et al. | 451/548 |
| 2010/0261420 | A1 * | 10/2010 | Kitajima et al. | 451/548 |
| 2010/0319673 | A1 * | 12/2010 | Cogswell | 125/15 |
| 2011/0165826 | A1 * | 7/2011 | Hoang et al. | 451/540 |
| 2012/0032203 | A1 * | 2/2012 | Urano | 257/88 |
| 2012/0164927 | A1 * | 6/2012 | Suh | 451/540 |

* cited by examiner

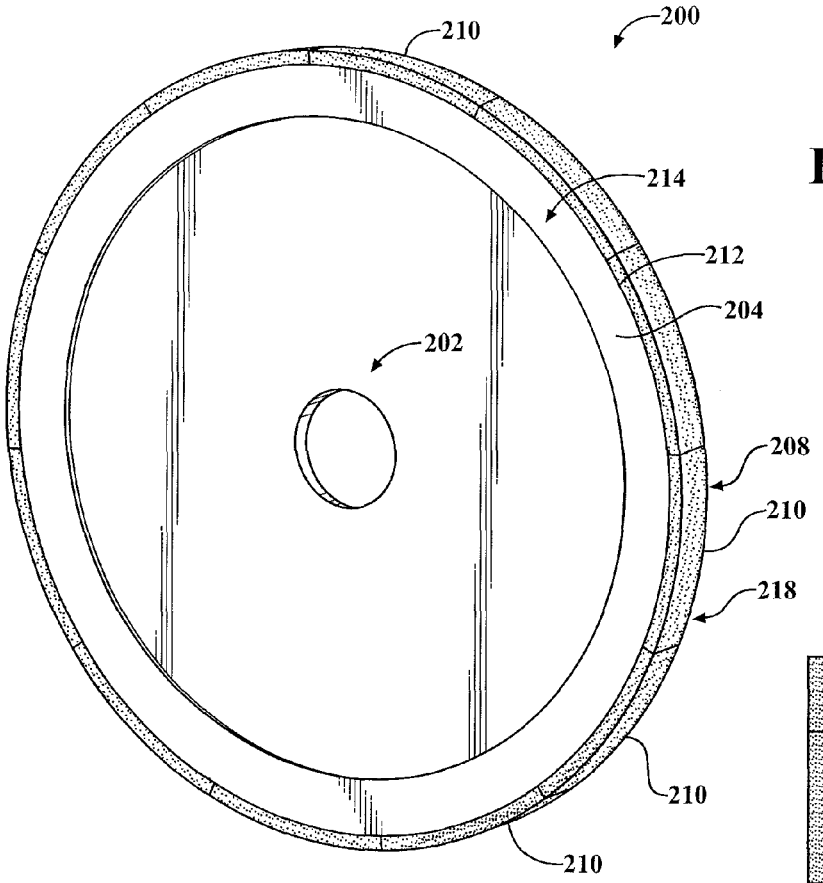
FIG. 8
FIG. 9
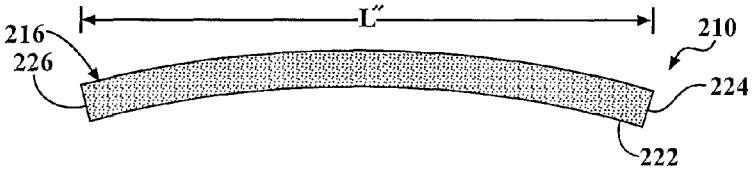
FIG. 10
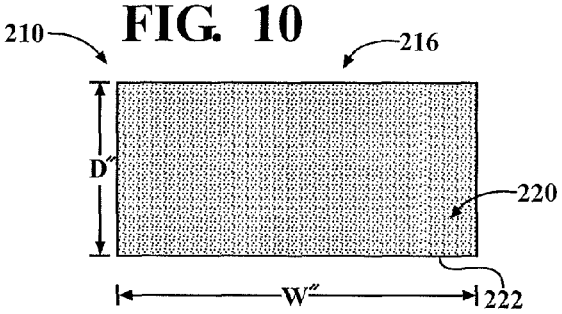
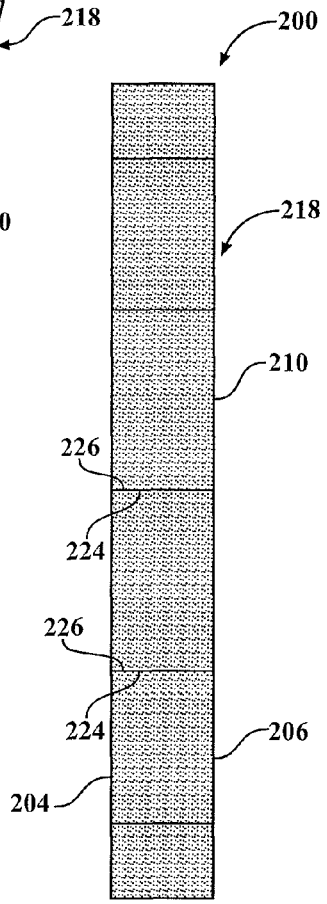
FIG. 11

FIG. 22
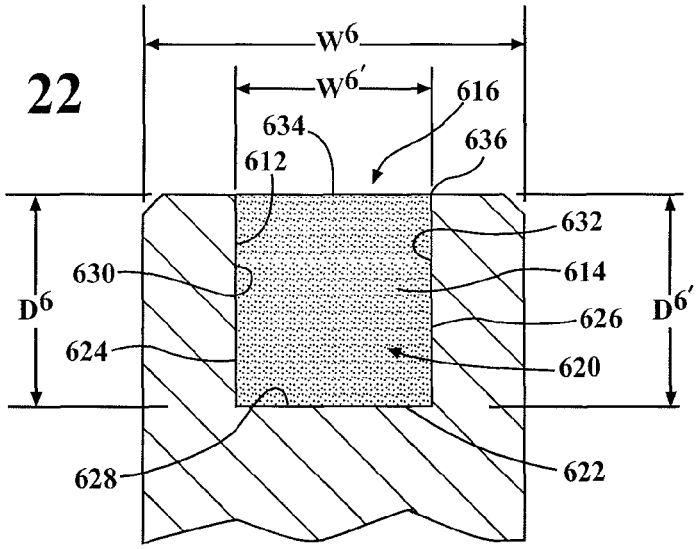
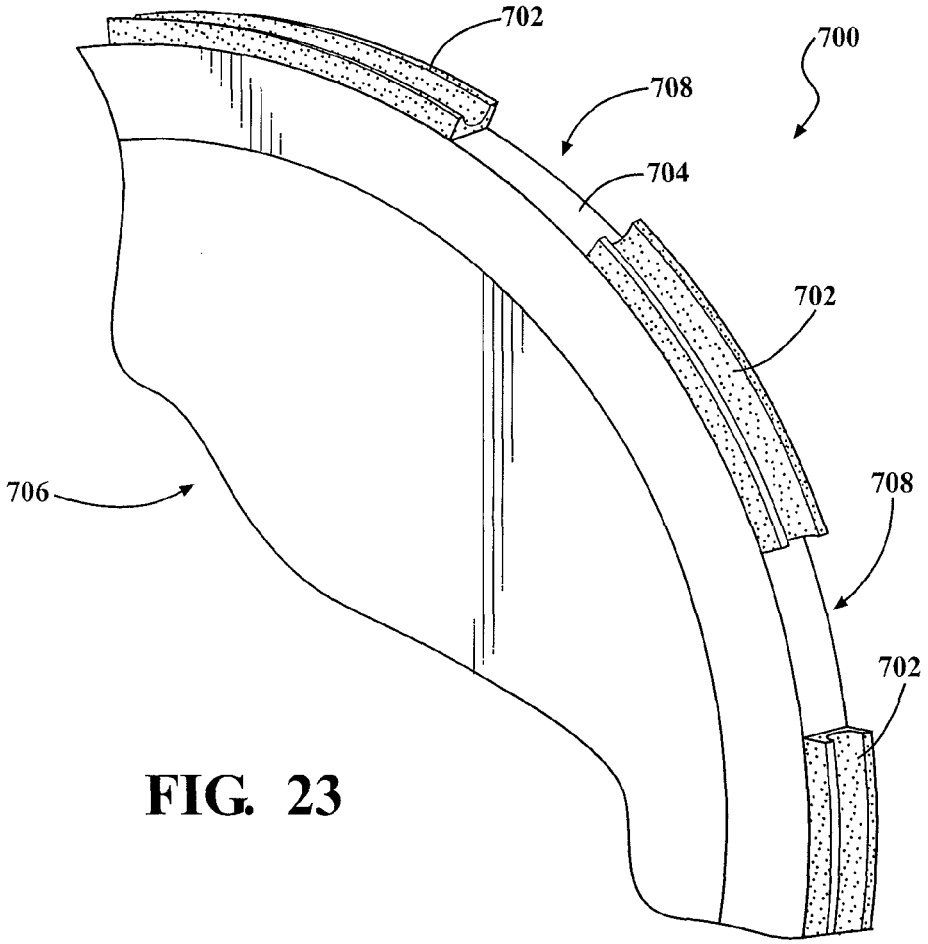
FIG. 23

SEGMENTED PROFILED WHEEL AND METHOD FOR MAKING SAME

CROSS-REFERENCE TO RELATED APPLICATION

The instant application claims priority to U.S. Provisional Patent Application Ser. No. 61/601,746 filed Feb. 22, 2012. The disclosure of the above application is incorporated herein by reference.

FIELD OF THE INVENTION

The present invention relates generally to a segmented superabrasive grinding wheel with a profile used for grinding of a glass and/or non-metallic workpiece.

BACKGROUND OF THE INVENTION

Of the various types of superabrasive grinding wheels, e.g., pencil edging wheels, used to finish and make a sheet of glass ready for mounting by grinding a desired profile on the edge of the sheet of glass, to give it the desired shape and profile, e.g., for mounting into a motor vehicle it is necessary to grind a profiled edge on the outer periphery of the glass to give it the desired cross-section or edge profile to engage with the opening and/or for safety. Generally, this is done by a grinding machine that includes a diamond grinding wheel for providing the desired contour having a profiled abrasive portion. By way of example, a form edge on the outer periphery of the glass can be done by a pencil edging grinding machine, which includes a pencil edging wheel for providing the final contour on the sheet of glass. Such known types of pencil edging wheels have an abrasive portion with a U-shaped cross section to put a full radius on the edge of the workpiece, e.g., on the upper edge of a retractable glass window of a vehicle to engage with the weatherstripping.

Generally, conventional diamond abrasive grinding wheels are expensive to manufacture and manufacturing results in a large amount of scrap. Manufacturing conventional diamond abrasive wheels begins with processing of a blank of metal and it is common for metal blanks weighing about 20 pounds to be used in the manufacturing of a single wheel. Typically, during the process of forming a conventional wheel, a large blank of steel of about 20 pounds is processed and machined until the final wheel weighs about 6 pounds with the profiled abrasive portion having been formed therein, e.g., the U-shaped profile of a diamond abrasive pencil edging profile is formed therein. Processing the diamond abrasive layer of conventional wheels results in extensive waste, e.g., loss of 25% of diamond matrix which is wasted, as well as increased labor costs and equipment costs since the abrasive portion profile, e.g., the U-shaped profile, must be formed in a secondary operation, e.g., grinding out the profile after sintering, forming during cold pressing, and/or heating of the abrasive layer in a mold with the core. Additionally, an extensive amount of manufacturing processing steps and energy is employed to turn the large expensive blank of steel into a single pencil edging wheel with a profile having an abrasive grit matrix for grinding. These extensive, largely manual, laborious manufacturing steps and material costs, as well as in-bound shipping and material handling demands, causes the cost of conventional wheels to be much higher than desirable. They also reduce disposability of conventional wheels owing to their higher replacement costs. Accordingly, there is a great and long felt need in the industry for a method of making a diamond abrasive grinding wheel that reduces the amount of material used and extensive steps required to make it.

Conventional diamond abrasive grinding wheels are expensive to procure initially due to wheel manufacturing and material costs and also expensive to maintain over time. Generally, the abrasive portion is formed of diamond grit bearing matrix or other expensive abrasive material(s) matrix. Over time the abrasive portion profile can become worn, which results in decreased accuracy and/or causing the need for re-profiling of the wheel. For example, over time the radius or U-shaped profile of the grinding portion of conventional pencil edging wheels can become flattened or otherwise undesirably worn down distorting the desired shape and profile of the workpiece. Since conventional grinding wheels are typically not disposable, owing to their high replacement costs, the oversized diamond section abrasive portions are often re-trued or re-profiled multiple times, rather than the entire wheel being replaced every time the profile becomes worn. Typically, worn conventional wheels are shipped back to the manufacturer or a supplier where they are re-trued and shipped back to the user, which is known to be costly and time consuming. It also results in decreased productivity and downtime until a worn wheel is re-trued and returned and/or requires the user to have back-up wheels in stock so that manufacturing downtime is reduced.

Additionally, abrasive portions of conventional grinding wheels are generally non-segmented. A common problem with these wheels is that the non-segmented abrasive portions are less precisely located on the metal core and have a weaker metallurgical bond to the steel core and less consistency of the diamond grinding section. Such imprecision, weakness and decreased diamond section consistency can result in less precise grinding and can cause the grinding surface to become worn more quickly, which again, reduces productivity and increases costs. Additionally, the use of non-metallic matrixes, e.g., a powdered non-metal bonding matrix, ceramic powders, vitrified segments, and the like, for the abrasive portion and/or any non-metallic backing layer of the abrasive portion mounted to the core of conventional wheels is known to not provide an adequate bond, is less hard, and results in premature wear of the grinding wheel.

Another common problem with conventional diamond abrasive grinding wheels is that the metal core, which is typically of expensive steel, cannot be re-used with replacement abrasive portions. Because of the high processing temperatures and pressures used in the processing of the diamond abrasive grinding wheel, the steel core made from a large blank is machined substantially oversized to allow for deformation and distortion in the sintering and/or hot pressing of the wheel. Once the abrasive portion is damaged or worn beyond use it cannot be replaced on the original metal core.

There are some known grinding wheels with segment abrasive sections or layers bonded to a polymer section or core. These wheels commonly have the aforementioned problems. Additionally, these sections or layers of conventional wheels are also bonded to one another using cast or other bonding methods, in addition to bonding to any backing layer, which requires more material and processing steps to form and dress the abrasive sections or layers and bond them to the core resulting in increased costs. It also reduces or eliminates replaceability of individual abrasive sections or layers.

There are also other known methods for profiling the abrasive layer, e.g., forming a U-shaped groove profile for grinding, however, these are known to create imprecise profiles and weaker bonds. One such conventional known method uses a stint or form in the abrasive layer adjacent the wheel core while in the mold during heating, which does not allow uniform pressure across the diamond section during cold and hot pressing and tight dimensional tolerances of the profile and creates a weaker bond. Thus, additional grinding or comparable processing of the profile to achieve the desired shape and dimensions is necessary. In addition, a conventional continuous sintered metal bond diamond section is less consistent than desired.

Accordingly, there exists a need to provide a segmented profiled wheel of the type used for shaping and contouring of glass and/or non-metallic material workpieces that improves the grinding performance and longevity of the segmented profiled wheel and an improved cost effective and efficient method for making same.

SUMMARY OF THE INVENTION

The present invention is directed to a segmented profiled wheel for profiling a workpiece, e.g., for profiling the outer periphery of glass or non-metallic workpieces, to give it the desired shape or edge profile. Preferably, the segmented profiled wheel is a metal bonded segmented grinding wheel. The segmented profiled wheel comprises a core with a hub portion that is adapted for attachment to a rotary power source, opposing first and second radially extending planar side portions, and a segmented abrasive portion coupled to the core, e.g., coupled to the peripheral surface of the core or toward the outer edge on the first and/or second radially extending planar side portions. The segmented abrasive portion comprises a plurality of abrasive segments having sufficient abrasive grit, e.g., a diamond powdered metal bonding matrix, to shape and contour the workpiece. The plurality of abrasive segments are coupled with terminal ends located adjacent to one another about the core and the workpiece contacts the cutting surface profile while the wheel rotates for grinding. Preferably, the plurality of abrasive segments are coupled with terminal ends directly abutting against one another on the core, e.g., about the periphery of the core, such that the segmented abrasive portion forms a continuous rim of abrasive segments, e.g., with a substantially continuous circumferential cutting surface profile.

The plurality of abrasive segments can have any cutting surface profile applied to any number of types of surfacing wheels suitable for grinding and profiling a workpiece. By way of non-limiting example, the plurality of abrasive segments can have a circumferential groove formed therein with a U-shaped pencil edging profile and sufficient abrasive grit to shape and contour the workpiece such that the segmented abrasive portion forms a substantially continuous rim of abrasive segments and the longitudinal length of the grooves align so that the workpiece can have continuous contact within the groove profiles while the wheel rotates for grinding, e.g., used for grinding a radius on the edge of the workpiece. Abrasive segments may also be spaced apart for example at an outlet of a cooling fluid flow feed hole. This can eliminate the need and cost of grinding or electric discharge machining (EDM) of the diamond section to open outlets or ports after the sintering and hot pressing used to form a conventional wheel.

In accordance with yet another embodiment of the present invention, a method of forming the segmented profiled wheel of the present invention includes a plurality of steps to help improve manufacturing costs, grinding performance, and longevity of the wheel. The method comprises forming a plurality of abrasive segments having a cutting surface profile, e.g., a groove formed therein with a U-shaped pencil edging profile, and sufficient abrasive grit for profiling the glass or a non-metallic workpiece to give it the desired cross-section or form edge profile. Generally, each of the plurality of abrasive segments can be sintered diamond bonded. Typically, the plurality of abrasive segments can be made by manual or automated processes, e.g., automated processes including the mixing and/or dosing of the powders, and/or pressing, and/or heating, and/or brazing, and/or cold pressing the segments, and/or the sintering of the segments. Preferably, the finished dimensions, arcuate shape, and cutting surface profile of the abrasive segments are all formed during the automated process with no secondary operation required such that, at most, minimal final truing of the segment is needed, e.g., to remove a thin lip or bur of material from the end(s) of the U-shaped groove and/or to angle the terminal ends of the abrasive segments or truing if desired. It can be advantageous to mold the abrasive segments with terminal ends that allow the segments to fit flush and adjacent to one another.

A metal blank is machined to form a core, e.g., a steel core or any other material that is dimensionally stable, with an arbor hole formed into it adapted for attachment to a rotary power source. The plurality of abrasive segments are attached adjacent to one another about the core, e.g., about the planar peripheral surface of the core or on at least one of said first and second planar side portions. Alternatively, a fitment groove can be machined into the circumferential surface of the core, into which the plurality of abrasive segments can be attached. Preferably, the abrasive segments are attached to the core by laser welding and/or metallic braze welding to help improve segment locating precision and to provide a stronger bond of the diamond abrasive segments to the core. The plurality of abrasive segments can be attached about the core such that terminal ends of abrasive segments are adjacent and the cutting surfaces along the longitudinal length of the abrasive segments align with one another to create a segmented abrasive portion that is a continuous rim of abrasive segments for the workpiece to have continuous contact with the circumferential cutting surface profile, e.g., within the groove profile, while the wheel rotates for grinding.

In an alternative embodiment, the plurality of abrasive segments are attached adjacent to one another about the core by adhering segments to the metal core using a thin adhesive layer, e.g., less than 3 millimeters. This allows new segments to be selectively adhered, e.g., about the planar peripheral surface of the wheel, within a groove or channel, and the like, and reuse of the core after the original wheel has expired. To attach new or replacement segments heat is applied to the worn out assembly to a high enough temperature to decompose the adhesive, the segment remnants are removed, and new segments are adhered in place of the worn segments. This cannot be done using conventional methods of bonding segments of vitreous materials to a polymer core or metal core, as the polymer core melts and/or the internal strength of segments is not as strong as the adhesive.

The plurality of abrasive segments can be operably attached spaced apart creating gaps or open areas between adjacent segments, the space required for the spacing of the abrasive segments is gained by the decrease in the amount of segments used, thereby reducing the cost of the wheel even further. To the contrary, open areas or slots in conventional wheels must be molded into the wheel using expensive molding procedures or using time consuming and expensive EDM machining to form the slots still further increasing the costs associated with conventional wheels.

Extensive trials and tests have shown that the present invention can help to reduce the amount of metal required to form the segmented profiled wheel by at least about 15 pounds as compared to conventional wheels. Additionally, since the plurality of abrasive segments can be produced substantially close to a finished size and with the profile formed into the segments, this can help reduce the required diamond cost and required metal powder cost by about 25% compared to conventional wheels. In addition, the present invention can help to decrease labor, materials, overhead costs, production costs, e.g., lowering the cost to make the wheel by about 50-70% compared to conventional wheels. Additionally, making individual abrasive segments can help make the segments more consistent with one another as compared to a conventional continuous sintered metal bond diamond section which is cold pressed onto a steel blank in a mold, heated, and then hot pressed. Generally, a conventional diamond section will vary 5-10 points Rockwell Hardness (FHB) from the standard of 100 for a particular metal bond specification. In the plurality of abrasive segments of the present invention, e.g., sintered metal bond abrasive segments, RHB varies only about 1-2 points across each segment. From segment to segment, the FHB is only about a maximum of 3 points FHB and if desired by selection of the appropriate segment may be less than 2 points variation in FHB. Unexpectedly, the RHB increased of each metal bond specification in a sintered segment by about 10 points over a conventional continuous diamond section. These results are unexpected and mean that the bonds produced using the process of the present invention are more durable, e.g., can extend the life over the conventional wheel.

Additionally, since the segments can be comprised of only the abrasive bonding material, each segment can be inspected and those of inferior properties can be rejected for use. Alternatively, those with identical properties can be matched to produce a superior performing grinding wheel, something heretofore deemed impossible.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 8 is a perspective view of a segmented profiled wheel, in accordance with yet another embodiment of the present invention;

FIG. 9 is a front elevation view illustrating an abrasive segment of the segmented profiled wheel depicted in FIG. 8, in accordance with the present invention;

FIG. 10 is an enlarged side elevation view of the abrasive segment depicted in FIGS. 8 and 9 of the segmented profile wheel, in accordance with the present invention;

FIG. 11 is a top plan view of the segmented profiled wheel depicted in FIGS. 8-10, in accordance with the present invention;

FIG. 22 is an enlarged cross sectional view of the segmented profiled wheel depicted in FIGS. 20-21, in accordance with the present invention;

FIG. 23 is a perspective view of a segmented profile wheel, in accordance with another embodiment of the present invention;

DETAILED DESCRIPTION OF THE PREFERRED EMBODIMENTS

Figure 1:
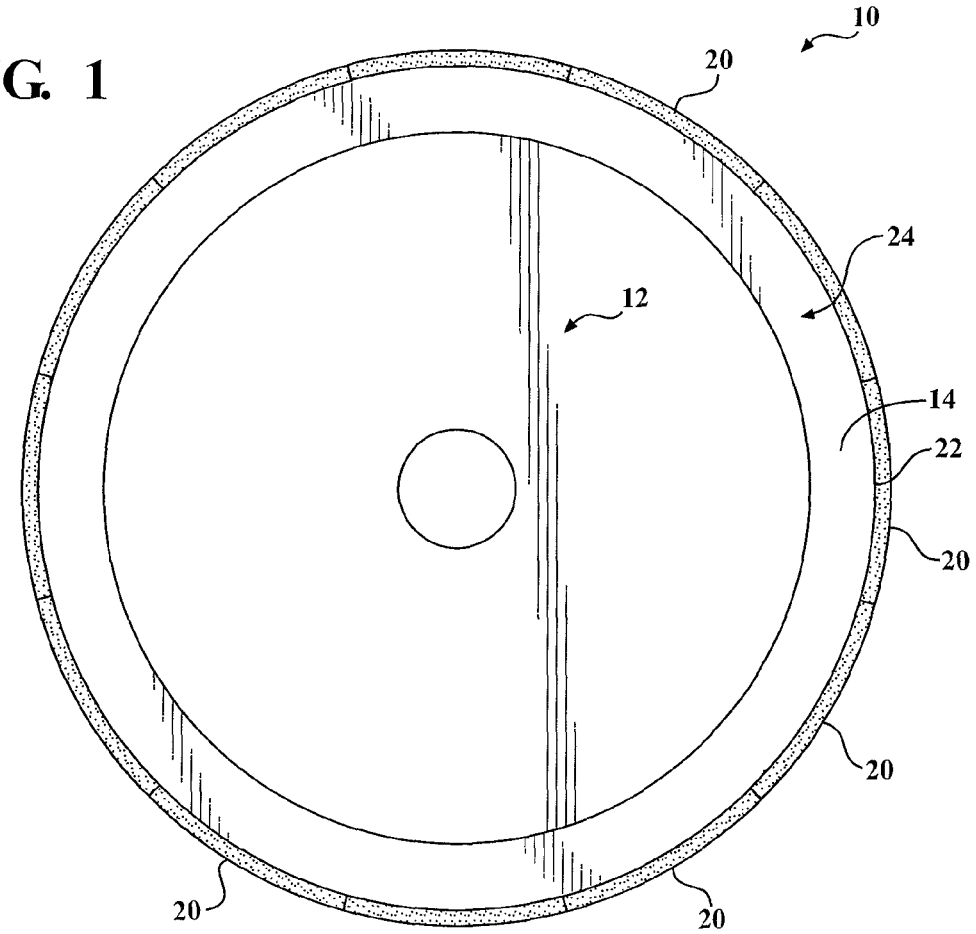
FIG. 1 is a front elevation view of a segmented profile wheel, in accordance with the present invention.
Figure 2:
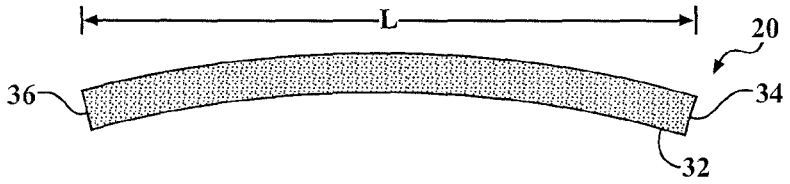
FIG. 2 is a front elevation view illustrating an abrasive segment of the segmented profiled wheel depicted in FIG. 1, in accordance with the present invention.
Figure 3:
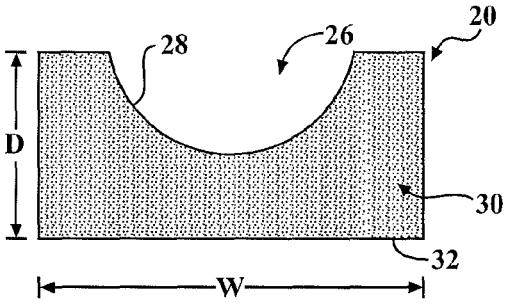
FIG. 3 is an enlarged side elevation view of the abrasive segment depicted in FIGS. 1 and 2 of the segmented profile wheel, in accordance with the present invention.
Figure 4:
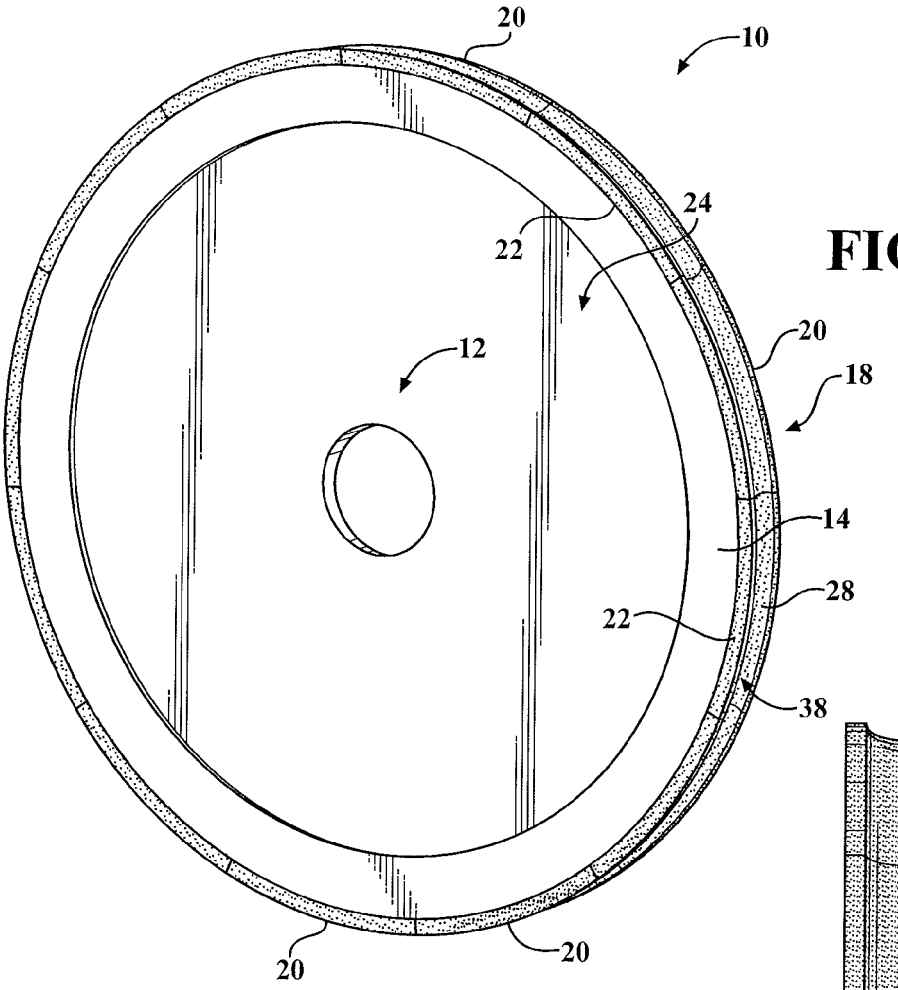
FIG. 4 is a perspective view of the segmented profiled wheel depicted in FIGS. 1-3, in accordance with the present invention.
Figure 5:
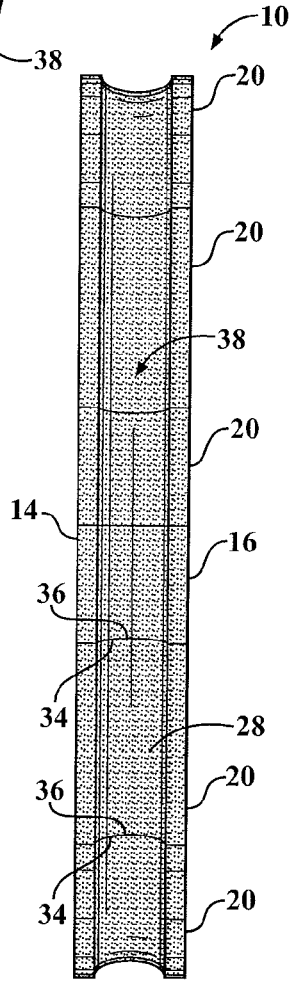
FIG. 5 is a top plan view of the segmented profiled wheel depicted in FIGS. 1-4, in accordance with the present invention.

The following description of the preferred embodiment(s) is merely exemplary in nature and is in no way intended to limit the invention, its application, or uses.

Referring to FIGS. 1-5 in general, a segmented profiled wheel 10 for grinding a radius on a flat edge of a cut glass or other non-metallic workpiece, e.g., on a glass table top edge, a retractable vehicle window glass, solar panels, and the like, to give it the desired cross-section or form edge profile in accordance with a first embodiment of the present invention is shown generally at 10. The segmented profiled wheel 10, e.g., a profiled edging wheel, includes a hub portion, shown generally at 12, operable for attachment to a rotary power source of a grinding machine, first and second radially extending planar side portions 14,16, and a segmented abrasive portion, shown generally at 18, that is an outer circumferential segmented abrasive portion.

The segmented abrasive portion 18 includes a plurality of abrasive segments 20 that are coupled to a peripheral surface 22 of a core, shown generally at 24, adjacent to one another to provide cutting surface profiles, shown generally at 26, that are circumferentially aligned for grinding the workpiece when the wheel rotates. The core 24 is preferably a metal core, e.g., a substantially solid steel core comprising a hub portion with an arbor hole molded into it adapted for attachment to a rotary power source, and the peripheral surface 22 is preferably substantially planar with no gaps, cutouts, or recesses formed therein. The plurality of abrasive segments 20 have a width W substantially equal to the width of the outer peripheral surface 22 of the core 24 and the inside diameter of the plurality of abrasive segments 20 is substantially equal to the outside diameter of the core 24, which helps to improve strength. The plurality of abrasive segments 20 can include a groove 28 formed therein along the entire longitudinal length L of each segment 20 extending in the circumferential direction and having a substantially U-shaped pencil edging profile and sufficient abrasive grit, shown generally at 30, to shape and contour the workpiece. It is understood that the plurality of abrasive segments 20 can have any alternative cutting surface profile, e.g., substantially flat across the width W direction of each segment, suitable for grinding as will be explained in greater detail below. The width W of the plurality of abrasive segments 20 being substantially equal to the width of the outer peripheral surface of the core 24 can further help to improve strength and stability of the plurality of abrasive segments 20. It is further understood that at least two abrasive segments 20 are used.

The plurality of abrasive segments 20 are also arcuate or arched along the longitudinal length L an operable amount, such that a bottom surface 32 on the plurality of abrasive segments 20 can attach along the circumferential peripheral surface 22 of the core 24. The plurality of abrasive segments 20 are coupled with terminal ends 34,36 of adjacent segments 20 located adjacent to one another, preferably directly abutting against one another, about the periphery of the core 24 such that the segmented abrasive portion 18 forms a substantially continuous rim of abrasive segments 20 and the longitudinal length of the grooves 28 align so that the workpiece can have continuous contact within the groove 28 profiles while the wheel 10 rotates for grinding. The terminal ends 34,36 are also angled an operable amount so that adjacent of plurality of abrasive segments 20 can be located adjacent to one another, e.g., substantially with no gap therebetween, about the periphery of the core 14. By way of example the terminal ends 34,36 can be operably angled in the direction from the outermost surface of the segment toward the bottom surface 32 in opposing orientations relative to one another, e.g., non-parallel with one another. Generally, the terminal ends 34,36 are angled by about 0.5 to 35 degrees. Typically, the terminal ends 34,36 are angled by about 1 to 20 degrees. Preferably, the terminal ends 34,36 are angled by about 5 to 10 degrees. It is understood that, alternatively, the plurality of abrasive segments 20 can be spaced apart about the periphery of the core 24, either substantially equally or irregularly spaced. It is further understood that the plurality of abrasive segments 20 are attached to the peripheral surface 22 of the core 24 and, preferably, the terminal ends 34,36 of adjacent segments 20 are not additionally bonded to one another. It is understood that, alternatively, the plurality of abrasive segments 20 can further comprise an abrasive layer and a non-diamond powdered metal backing material layer used for attaching the abrasive segments 20 to the core 24, as will be explained in greater detail below.

By way of non-limiting example, twelve abrasive segments 20 having an operable longitudinal length L can be attached to the core 24 to form the segmented abrasive portion 18 with a substantially continuous circumferential groove, shown generally at 38, comprised of the aligned grooves 28 about the circumference of a, e.g., a 200 mm diameter, segmented profiled wheel 10. The substantially continuous rim of abrasive segments 20 substantially with no gaps helps to improve strength and help improve preventing an interrupted cut during grinding. It is understood that more or less abrasive segments 20 can be used. Preferably, at least twelve abrasive segments 20 are used. Preferably, at most the longitudinal length L of the segments is about 52 mm. Preferably, the longitudinal length L of the plurality of abrasive segments 20 are substantially equal. It is understood that it is within the contemplation of the present invention that, alternatively, at least one of the longitudinal lengths L can be different. The continuous circumferential groove 38 is located about the outer periphery of the segmented profiled wheel 10 and, preferably, each groove 28 is formed substantially at the center of the width W of the plurality of abrasive segments 20 for receiving and grinding the edge of the workpiece.

Generally, the depth D and width W of the plurality of abrasive segments 20 is operable to form a U-shaped groove 28 profile therein and to accommodate re-truing or re-profiling of the plurality of abrasive segments 20. By example, the depth D can be at least about 3.10 mm and the width W can be at least about 6.50 mm to accommodate a groove 28 formed therein that can have a depth of at least about 1.71 mm, width of at least about 4.06 mm, and a radius of at least about R2.06 mm. It is understood that the depth D can be greater to help increase the number of times the plurality of abrasive segments 20 can be re-trued thereby extending the usability of the wheel. It is further understood that the depth D can be operably greater than or less than about 3.10 mm. It is further understood that the width W can be operably greater than or less than about 6.5 mm. Each of the plurality of abrasive segments 20 can be, by example, arched by at least about 30 degrees. The arcuate abrasive segments 20 can have an inside radius R' of at least about R96.9 mm and outside radius R" of at least about R100.4 mm. Preferably, the depth D provides a surface thickness of abrasive material, e.g., powdered metal bonding matrix with diamond mixed therein, attached to the metal core 24, as illustrated in the drawings.

It is understood that the dimensions of the plurality of abrasive segments 20 and the grooves 28 formed therein can selectively vary depending on the workpiece dimensions and the desired edge profile to be formed and that the segmented abrasive portion 18 and/or abrasive portions 20 of the wheel can be replaced and/or re-trued or re-profiled when worn. Preferably, the core 24 of the segmented profiled wheel 10 is a common or interchangeable core 24 that can be used across a number of wheel product platforms with numerous abrasive segment 20 types. Preferably, the dimensions of the plurality of abrasive segments 20 and the grooves 28 can be selectively changed to accommodate numerous segmented edging wheel 10 products, e.g., segments for a wheel used to profile a thicker solar panel can have different dimension(s) than segments for a wheel to profile a thinner window panel, and can be coupled to the interchangeable core 24 to accommodate these various product platforms. Another benefit to the interchangeable cores 24 helping to reduce costs is that this can lower the overall wheel production and manufacturing costs of the respective segmented profiled wheel allowing the wheels to be more disposable and helping to offer a cost effective alternative to re-truing worn wheels and/or replacing more expensive wheels.

The plurality of abrasive segments 20 can be attached to the core 24 by laser welding and/or brazing the segments 20 to the peripheral surface 22 of the core 24, which helps to improve bond strength between the metal core 24 and plurality of abrasive segments 20 and allows more precise placement of the segments, as will be explained in greater detail below. In an alternative embodiment, the plurality of abrasive segments 20 are attached adjacent to one another about the core by adhering segments to the metal core using adhesives. This allows new segments to be selectively adhered, e.g., about the planar peripheral surface of the wheel, and reuse of the core after the original segments have worn. When using an adhesive the layer is necessarily thin, e.g., less than 3 millimeters, such that the components absorb the stresses, not the adhesive, as the sintered metal bonded diamond segment and the metal core can absorb much more of the physical forces in operation than the adhesive or a bonding layer. To attach new or replacement segments, heat is applied to the worn out assembly to a high enough temperature to decompose the adhesive, the segment remnants are removed, and new segments are adhered in place of the worn segments. This cannot be done using conventional methods of bonding segments of vitreous materials to a polymer core, e.g., the polymer core melts.

It is understood that, alternatively, the plurality of abrasive segments 20 can comprise an abrasive layer and a backing layer used for attaching the abrasive segments 20 to the core 24, as will be explained in greater detail below.

Figure 6:
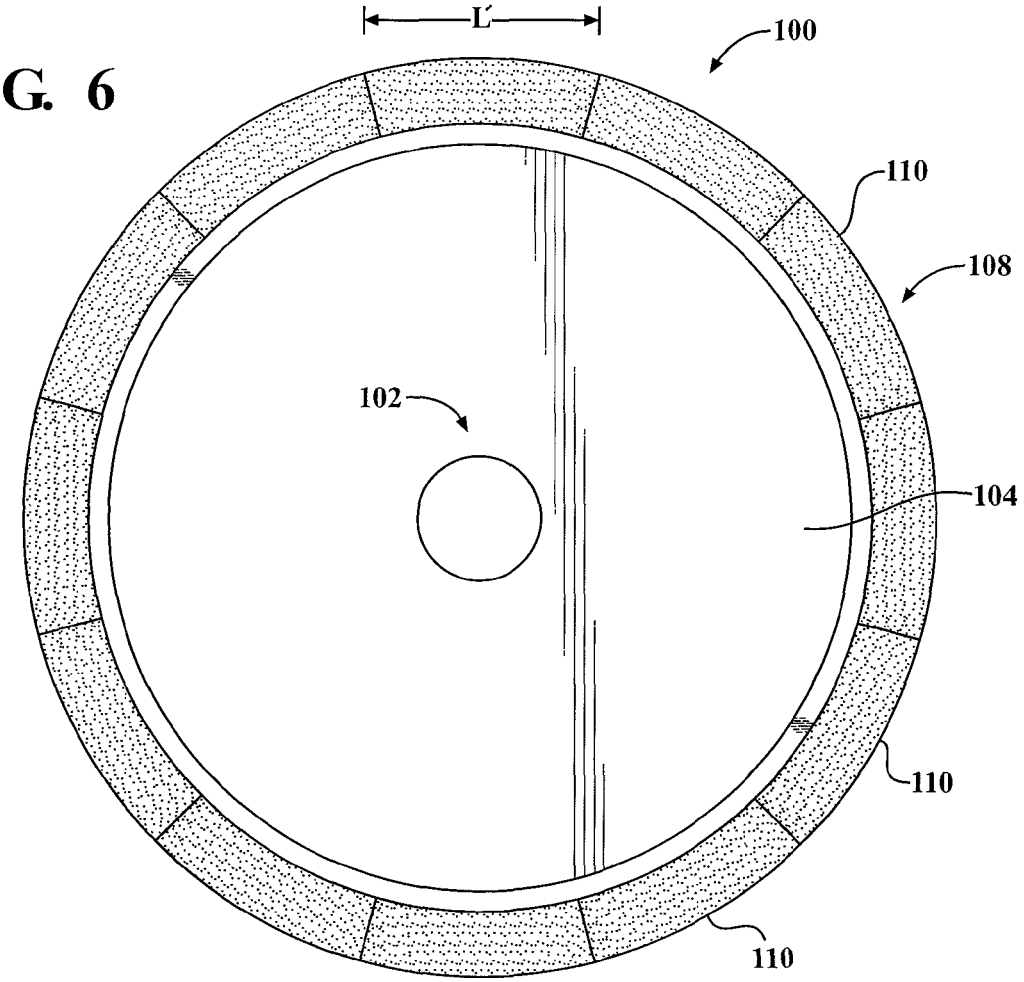
FIG. 6 is a front elevation view of a segmented profiled wheel, in accordance with another embodiment of the present invention.
Figure 7:
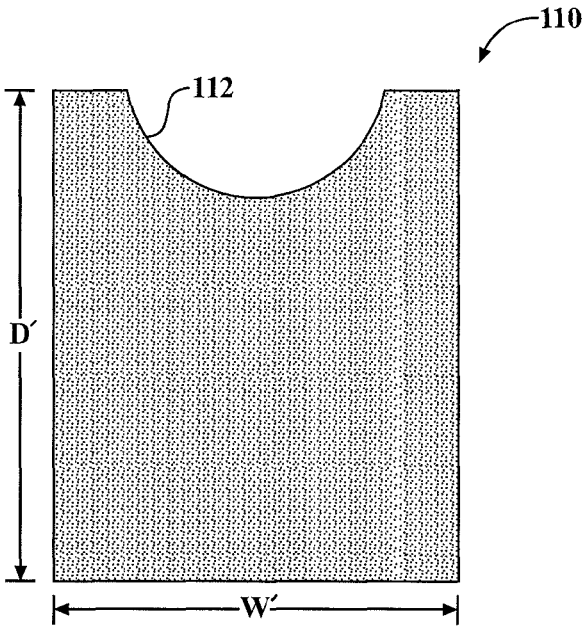
FIG. 7 is an enlarged side elevation view of an abrasive segment depicted in FIG. 6 of the segmented profiled wheel, in accordance with the present invention.

Referring to FIGS. 6-7 in general, there is illustrated a segmented profiled wheel, shown generally at 100, in accordance with another embodiment of the present invention depicting a depth D' that is thicker. The segmented profiled wheel 100 is similar to that depicted in FIGS. 1-5, e.g., comprises a hub portion 102 of a core operable for attachment to a rotary power source, first planar side portion 104, second planar side portion, and an outer circumferential segmented abrasive portion, shown generally at 108, having a plurality of abrasive segments 110, and illustrates the plurality of abrasive segments 110 having a depth D' that is operably thicker to help increase longevity of the wheel. Increasing the depth D' can help increase the number of times the plurality of abrasive segments 110 can be re-trued thereby extending the usable life of the wheel.

The depth D' and width W' of the plurality of abrasive segments 110 can be operable to form a U-shaped groove 112 profile therein and to accommodate re-truing or re-profiling of the plurality of abrasive segments 110. It is understood that, alternatively, the plurality of abrasive segments 110 can have any alternative cutting surface profile, e.g., U-shaped, substantially flat, concave, convex, Vee groove, and the like, suitable for grinding glass and non-metallic workpieces. It is further understood that at least two abrasive segments 110 are used. Generally, the depth D' can be greater than 3.10 mm and the width W' can be at least about 6.50 mm. Typically, the depth D' is between about 3.10 mm and about 12 mm. Preferably, the depth D' is greater than about 3.10 mm. By way of non limiting example, the depth D' is between about 3.10 mm and about 6.20 mm. Preferably, at least twelve abrasive segments 110 are used. Preferably, at most the longitudinal length L' of the segments extending in the circumferential direction is about 52 mm. Preferably, the longitudinal length L' of the plurality of abrasive segments 110 are substantially equal, however, it is understood that it is within the contemplation of the present invention that at least one of the longitudinal lengths L' can alternatively be different. The depth D' provides a surface thickness of abrasive material attached to the peripheral surface of the metal core, as illustrated in the drawings.

It is understood that, alternatively, the plurality of abrasive segments 110 can comprise an abrasive layer and a backing layer used for attaching the abrasive segments 110 to the core, as will be explained in greater detail below.

Referring to FIGS. 8-11 in general, a segmented profiled wheel in accordance with another embodiment of the present invention for grinding of a cut glass or other non-metallic workpiece, e.g., a glass table top edge, a retractable vehicle window glass, solar panels, and the like, to give it the desired profile is shown generally at 200. The segmented profiled wheel 200 includes a hub portion, shown generally at 202, operable for attachment to a rotary power source of a grinding machine, first and second radially extending planar side portions 204,206, and a segmented abrasive portion, shown generally at 208, that is an outer circumferential segmented abrasive portion with a flatter cutting surface profile.

The segmented abrasive portion 208 includes a plurality of abrasive segments 210 that are attached to the peripheral surface 212 of a core, shown generally at 214, adjacent to one another to provide cutting surface profiles, shown generally at 216, that are circumferentially aligned and can form a circumferential cutting surface profile 218 for grinding the workpiece when the wheel rotates. The cutting surface profile 216 of the plurality of abrasive segments 210 can be a flatter profile, e.g., substantially flat across the width W" direction and with no U-shaped groove formed therein. It is understood that the plurality of abrasive segments 210 can have any alternative cutting surface profile 216, e.g., concave, convex, angled, Vee groove, and the like, suitable for grinding glass and non-metallic workpieces. It is further understood that at least two abrasive segments 210 are used.

The core 214 is preferably a metal core, e.g., a substantially solid steel with an arbor hole molded into it adapted for attachment to a rotary power source, and the peripheral surface 212 is preferably substantially planar with no gaps, cutouts, or recesses formed therein. The plurality of abrasive segments 210 have a width W" substantially equal to the outer peripheral surface 212 of the core 214 and the inside diameter of the plurality of abrasive segments 210 is substantially equal to the outside diameter of the core 214, which helps to improve strength. The plurality of abrasive segments 210 also have sufficient abrasive grit, shown generally at 220, to shape and contour the workpiece.

The plurality of abrasive segments 210 are also arcuate or arched along the longitudinal length L" an operable amount, such that a bottom surface 222 on the segments 210 can attach along the circumferential peripheral surface 212 of the core 214. The plurality of abrasive segments 210 are coupled with terminal ends 224,226 of adjacent segments 210 located adjacent to one another, preferably directly abutting against one another, about the periphery of the core 214 such that the segmented abrasive portion 208 forms a substantially continuous rim of abrasive segments 210 and the cutting surfaces align 216 so that the workpiece has continuous contact with the cutting surface profile 218 while the wheel rotates for grinding. The terminal ends 224,226 are also angled an operable amount so that adjacent of plurality of abrasive segments 210 can be located adjacent to one another, e.g., substantially with no gap therebetween, about the periphery of the core 214. By way of example the terminal ends 224,226 can be operably angled in the direction from the outermost surface of the segment toward the bottom surface 222 in opposing orientations relative to one another. It is understood that, alternatively, the plurality of abrasive segments 210 can be spaced apart about the periphery of the core 214, either substantially equally or irregularly spaced. It is further understood that the plurality of abrasive segments 210 are attached to the peripheral surface 212 of the core 214 and, preferably, the terminal ends 224,226 of adjacent segments 210 are not additionally bonded to one another.

By way of non-limiting example, twelve abrasive segments 210 in a 30 degree arc having an operable longitudinal length L" extending in the circumferential direction can be attached to the core 214 to form the segmented abrasive portion 208 with the substantially continuous cutting surface profile 218 comprised of the plurality of circumferential cutting surface 216 profiles about the circumference of a, e.g., a 200 mm diameter, segmented profiled wheel 200. The substantially continuous rim of abrasive segments 210 substantially with no gaps helps to improve strength and to help prevent an interrupted cut. It is understood that more or less abrasive segments 210 can be used. Preferably, at least twelve abrasive segments 210 are used. Preferably, at most the longitudinal length L" of the segments is about 52 mm. Preferably, the longitudinal length L" of the plurality of abrasive segments 210 are substantially equal. It is understood that it is within the contemplation of the present invention that, alternatively, at least one of the longitudinal lengths L" can be different.

Generally, the depth D" and width W" of the plurality of abrasive segments 210 is operable to form the cutting surface 216 profile and to accommodate re-truing or re-profiling of the plurality of abrasive segments 210, e.g., worn, rippled, dimpled, protruding, notched, and the like worn cutting surfaces can be operably re-shaped or flattened across the width W" direction by re-truing or re-profiling. The depth D" can be at least about 3.10 mm and the width W" can be at least about 6.50 mm. It is understood that the depth D" can be greater to help increase the number of times the plurality of abrasive segments 210 can be re-trued thereby extending the usability of the wheel. It is understood that the depth D' can be operably greater than or less than about 3.10 mm. It is further understood that the width W" can be operably greater than or less than about 6.50 mm. Each of the plurality of abrasive segments 210 is arched by at least about 30 degrees. The arcuate abrasive segments 210 can have an inside radius of at least about R96.9 mm and outside radius of at least about R100.4 mm. Preferably, the depth D" provides a surface thickness of abrasive material attached to the metal core 214. The thickness of the abrasive material can be substantially level across the width W".

It is understood that, alternatively, the plurality of abrasive segments 210 can comprise an abrasive layer and a non-diamond powdered metal backing material layer used for attaching the abrasive segments 210 to the core 214, as will be explained in greater detail below.

It is understood that the dimensions of the plurality of abrasive segments 210 and the cutting surface 216 profile formed can selectively vary depending on the workpiece dimensions and the desired workpiece profile to be formed. The plurality of abrasive segments 210 of the segmented abrasive portion 208 of the wheel can be replaced, individually and/or collectively, and/or re-trued or re-profiled when worn. The core 214 of the segmented profiled wheel 200 can be a common or interchangeable core 214 that can be used across a number of wheel product platforms with numerous abrasive segment 210 types. Preferably, the dimensions of the plurality of abrasive segments 210 can be selectively changed to accommodate numerous segmented profiled wheel 200 products, e.g., to accommodate thinner solar panels and the like.

The plurality of abrasive segments 210 can be attached to the core 214 by laser welding and/or brazing the segments 210 to the peripheral surface 212 of the core 214, which helps to improve bond strength between the metal core 214 and plurality of abrasive segments 210 and allows more precise placement of the segments, as will be explained in greater detail below. In an alternative embodiment, the plurality of abrasive segments 210 are attached adjacent to one another about the core by adhering segments to the metal core using adhesives.

Figure 12:
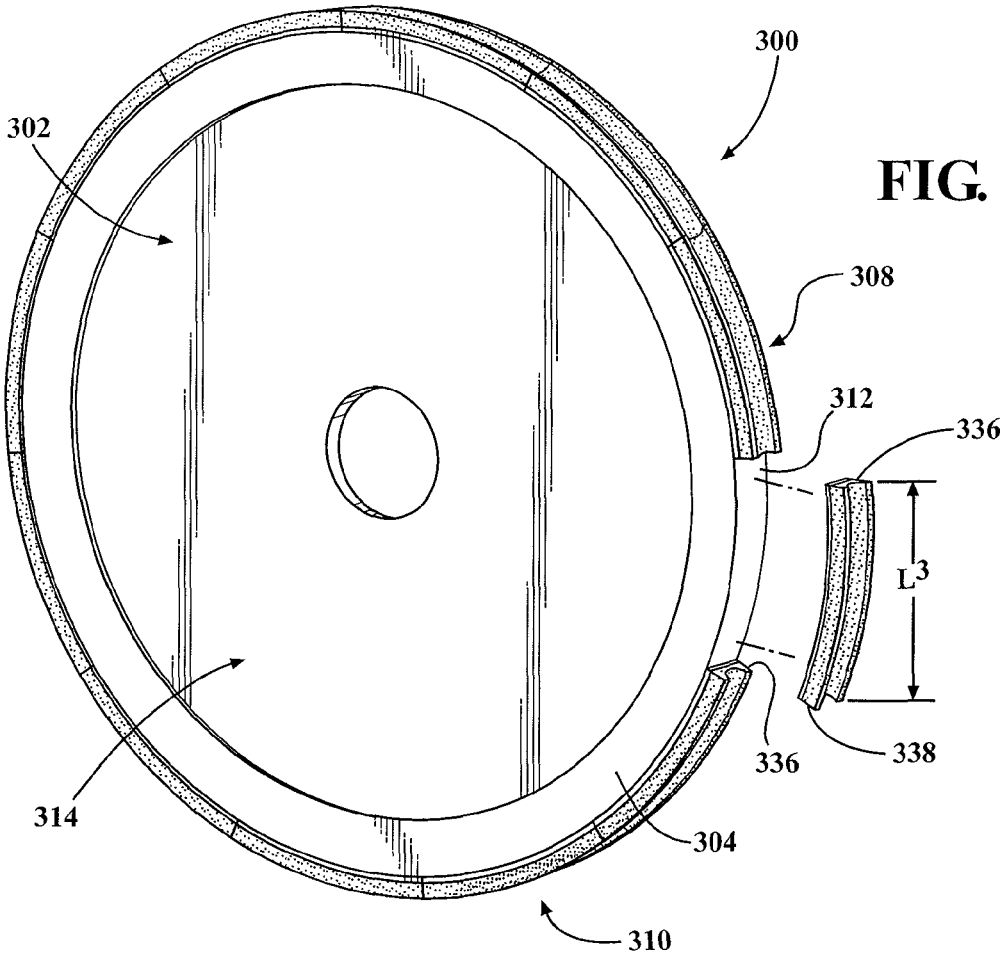
FIG. 12 is a perspective view of a segmented profiled wheel that is partially broken-away to depict an abrasive segment and recess, in accordance with yet another embodiment of the present invention.
Figure 13:
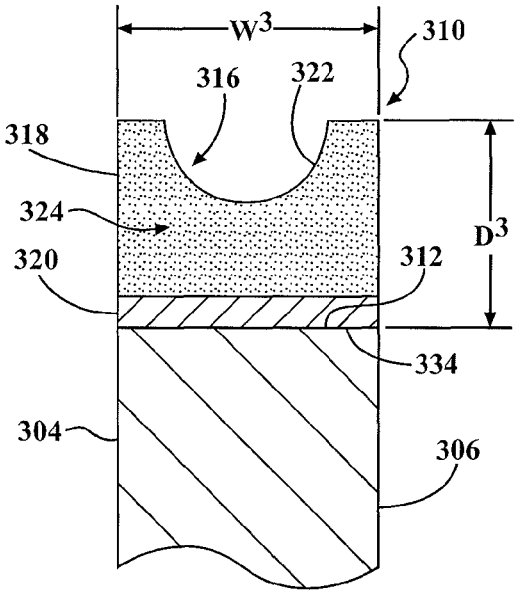
FIG. 13 is an enlarged cross sectional view of the segmented profiled wheel depicted in FIG. 12, in accordance with the present invention.
Figure 14:
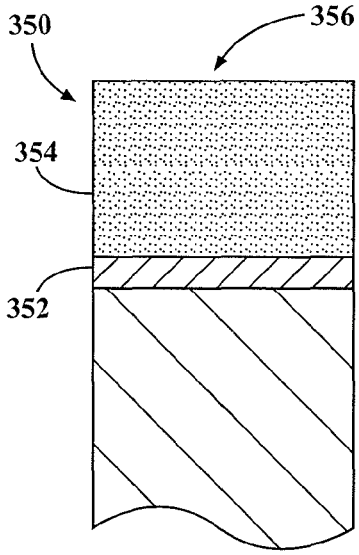
FIG. 14 is an enlarged cross sectional view of a segmented profiled wheel, in accordance with another embodiment of the present invention.

Referring to FIGS. 12-14 generally, in accordance with another embodiment of the present invention, there is provided a segmented profiled wheel shown generally at 300 for grinding a glass and/or non-metallic workpiece. The segmented profiled wheel 300 is similar to the segmented profiled wheels 10,100,200 shown in FIGS. 1-11, e.g., includes a hub portion, shown generally at 302, operable for attachment to a rotary power source of a grinding machine, first and second radially extending planar side portions 304,306, and a segmented abrasive portion, shown generally at 308, that is an outer circumferential segmented abrasive portion. The segmented abrasive portion 308 also includes a plurality of abrasive segments 310 that are arcuate to attach to the peripheral surface 312 of a core, shown generally at 314 and that can be interchangeable, adjacent to one another to provide cutting surface profiles, shown generally at 316, that are circumferentially aligned for grinding the workpiece when the wheel rotates.

The plurality of abrasive segments 310 comprise an abrasive layer 318 and a backing layer 320. The backing layer is a non-diamond powdered metal backing material layer used for attaching the abrasive segments 310 to the core 314. The backing layer 320 is a metallurgically attached intermediate layer.

The backing layer 320 can be attached to the core 314 by laser welding and/or brazing the segments 310 to the peripheral surface 312 of the core 314, which helps to improve bond strength between the metal core 314 and plurality of abrasive segments 310 and allows more precise placement of the segments, as will be explained in greater detail below. Additionally, the abrasive layer 318 can be attached to the backing layer 320 by laser welding and/or brazing. Preferably, the abrasive layer 318 comprises a powdered metal bonding matrix with diamonds mixed therein and the backing layer 320 comprises a non-diamond powdered metal matrix, to improve bond strength. It is understood that, alternatively, the abrasive layer 318 can comprise a powdered metal bonding matrix with diamond-like hardness abrasive grit or other materials such as silicon carbides, tungsten carbides, oxides, garnets, cubic boron nitride, and natural and synthetic diamonds used alone or in combination mixed with the powdered metal. The backing layer 320 can comprise substantially the same powdered metal bonding matrix, or comparable, as the abrasive layer 318, but without the diamonds mixed therein. In an alternative embodiment, the plurality of abrasive segments 310 are attached adjacent to one another about the core by adhering segments to the metal core using adhesives.

The plurality of abrasive segments 310 have a width $W^3$ substantially equal to the width of the outer peripheral surface of the core 314 and the inside diameter of the plurality of abrasive segments 310 is substantially equal to the outside diameter of the core 314, which helps to improve strength. The plurality of abrasive segments 310 can include a groove 322 formed therein along the longitudinal length $L^3$ of each segment 310 extending in the circumferential direction and having a substantially U-shaped pencil edging profile and sufficient abrasive grit, shown generally at 324, to shape and contour the workpiece. It is understood that the plurality of abrasive segments 310 can have any alternative cutting surface profile 316 suitable for grinding, e.g., substantially flat as depicted in FIG. 14.

The plurality of abrasive segments 310 are also arcuate or arched along the longitudinal length $L^3$ an operable amount, such that a bottom surface 334 on the backing layer 320 of the plurality of abrasive segments 310 can attach along the circumferential peripheral surface 312 of the core 314. The plurality of abrasive segments 310 are coupled with terminal ends 336,338 of adjacent segments 310 located adjacent to one another, preferably directly abutting against one another, about the periphery of the core 314 such that the segmented abrasive portion 308 forms a continuous rim of abrasive segments 310 and the cutting surface profiles 316 align so that the workpiece can have continuous contact, e.g., within the groove 322 profiles shown in FIGS. 12 and 13 while the wheel 300 rotates for grinding. The terminal ends 336,338 are also angled an operable amount so that adjacent of plurality of abrasive segments 310 can be located adjacent to one another, e.g., substantially with no gap therebetween, about the periphery of the core 314. By way of example the terminal ends 336,338 can be operably angled in the direction from the outermost surface of the segment toward the bottom surface 334 in opposing orientations relative to one another. It is understood that, alternatively, the plurality of abrasive segments 310 can be spaced apart about the periphery of the core 314, either substantially equally or irregularly spaced. It is further understood that the plurality of abrasive segments 310 are attached to the peripheral surface 312 of the core 314 and, preferably, the terminal ends 336,338 of adjacent segments 310 are not additionally bonded to one another. It is understood that at least two abrasive segments 310 are used.

By way of non-limiting example, twelve abrasive segments 310 in a 30 degree arc having an operable longitudinal length $L^3$ extending in the circumferential direction can be attached to the core 314 to form the segmented abrasive portion 308 about the circumference of a segmented profiled wheel 300. It is understood that more or less abrasive segments 310 can be used. Preferably, at most the longitudinal length $L^3$ of the segments is about 52 mm. Preferably, the longitudinal length $L^3$ of the plurality of abrasive segments 310 are substantially equal. It is understood that it is within the contemplation of the present invention that, alternatively, at least one of the longitudinal lengths $L^3$ can be different.

Generally, the depth $D^3$ and width $W^3$ of the plurality of abrasive segments 310 is operable to form the cutting surface profile 316 therein, to accommodate re-truing or re-profiling and/or replacement of the plurality of abrasive segments 310, and to accommodate the backing layer 320 for attaching to the core 314. By way of example, in an abrasive segment 310 for a 175 mm diameter welded segment wheel, the depth $D^3$ can be at least about 5.21 mm; comprised of at least about 3.51 mm of the abrasive layer 318 and at least about 1.71 mm of the backing layer 320 to accommodate the groove 322 formed in the abrasive layer 318 that can have a groove depth of at least about 0.965 mm, width of at least about 2.74 mm, and a radius of at least about R1.50 mm. The width $W^3$ can be at least about 6.5 mm. The plurality of abrasive segments 310 can be arched by at least about 30 degrees. The arcuate abrasive segments 310 can have an inside radius of at least about R82.5 mm and outside radius of at least about R87.7 mm. By way of second example, in an abrasive segment 310 for a 150 mm diameter welded segment wheel, the arcuate abrasive segments 310 can have an inside radius of at least about R75.21 mm and outside radius of at least about R70.00 mm. In this example, the depth $D^3$ can also be at least about 5.21 mm; at least about 3.51 mm for the abrasive layer 318 and at least about 1.71 mm for the backing layer 320 to accommodate the groove 322 formed in the abrasive layer 318 that can have a groove depth of at least about 0.965 mm, width of at least about 2.74 mm, and a radius of at least about R1.50 mm. The width $W^3$ can be at least about 6.5 mm. Each of the plurality of abrasive segments 310 can be arched by at least about 30 degrees. It is understood that the depth $D^3$ can be greater to help increase the number of times the plurality of abrasive segments 310 can be re-trued thereby extending the usability of the wheel.

Referring more particularly to FIG. 14, FIG. 14 depicts an enlarged cross sectional view of the segmented profiled wheel having an abrasive segment, shown generally at 350, comprising a backing layer 352 and an abrasive layer 354 attached thereto with a cutting surface profile, shown generally at 356, that is substantially flat across the width direction and sufficient abrasive grit. The thickness of the abrasive grit can be substantially level across the width of the abrasive layer 354. The thickness of the backing layer 352 can be substantially level across the width of the backing layer 352.

Figure 15:
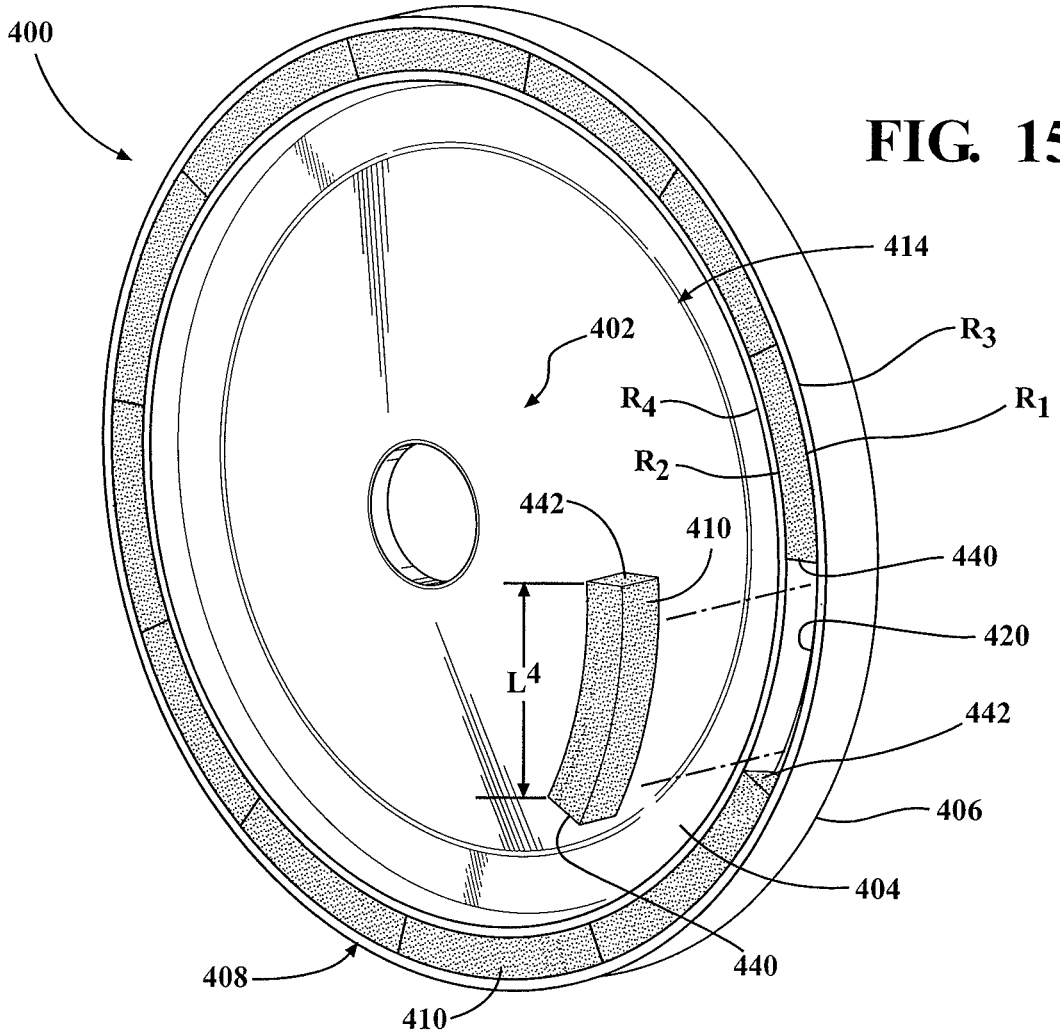
FIG. 15 is a perspective view of a segmented profiled wheel that is partially broken-away to depict an abrasive segment and recess, in accordance with yet another embodiment of the present invention.
Figure 16:
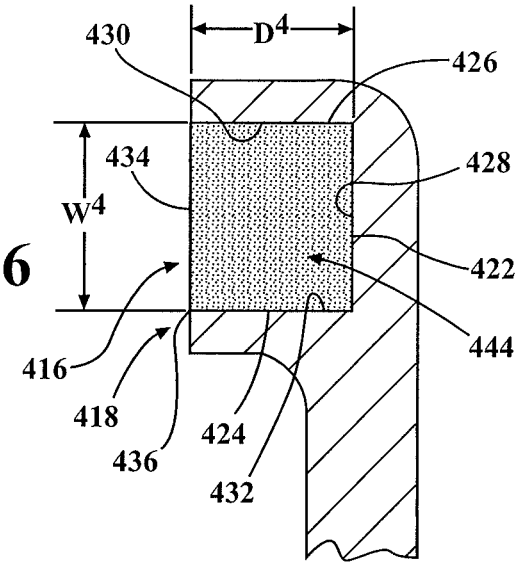
FIG. 16 is a cross sectional view of the segmented profiled wheel depicted in FIG. 15, in accordance with the present invention.

Referring to FIGS. 15-16 generally, in accordance with another embodiment of the present invention, there is provided a segmented profiled wheel shown generally at 400 for grinding a glass and/or non-metallic workpiece. The segmented profiled wheel 400, e.g., a cup wheel, is similar to the segmented profiled wheels 10,100,200,300 shown in FIGS. 1-14, e.g., the wheel 400 includes a hub portion, shown generally at 402, with an arbor hole formed into it operable for attachment to a rotary power source of a grinding machine, first and second radially extending planar side portions 404, 406, and a segmented abrasive portion, shown generally at 408 comprised of a plurality of abrasive segments 410 attached to a core, shown generally at 414, adjacent to one another to provide cutting surface profiles, shown generally at 416, that are aligned for grinding the workpiece when the wheel rotates.

The plurality of abrasive segments 410 are not attached to the outer periphery of the core 414. The first and/or second planar side portions 404,406 of the core 414 includes a protruding flange, shown generally at 418, that can form a continuous flange located toward the outside edge on the first and/or second planar side portions 404,406. The protruding flange has a recess 420 formed therein, e.g., a squared off recess or groove with a substantially planar bottom and vertical sides. The plurality of abrasive segments 410 can extend laterally through an opening 436 into the recess 420, e.g., substantially transverse to the peripheral surface of the wheel, and be held therein. FIG. 15 depicts the segmented profiled wheel 400 partially broken-away to illustrate a portion of the recess 420 and one of the plurality of abrasive segments 410 that fits therein.

A bottom surface 422 and/or at least one opposing side surface(s) 424,426 of the plurality of abrasive segments 410 are attached within the recess 420 to a bottom 428 and/or at least one opposing internal vertical sides 430,432 of the protruding flange 418 within the recess 420 substantially with no gaps therebetween. Preferably, a top surface 434 of the plurality of abrasive segments is substantially flush with the opening 436 of the recess 420. While the top surface 434 of the plurality of abrasive segments 410 is shown substantially flush with the opening 436 plane of the recess 420, it is understood that, alternatively, the plurality of abrasive segments 410 can extend partly through the opening 436 such that the top surface 434 is above the opening 436 plane outside of the recess 420. Preferably, the bottom surface 422 of the plurality of abrasive segments 410 is located against the bottom 428 of the recess 420 and the depth $D^4$ of the plurality of abrasive segments 410 extends at least to the plane across the opening 436 of the recess 420. The squared off recess 420 and opposing squared off abrasive segment 410 configuration can further help to improve strength and stability of the plurality of abrasive segments 410. Preferably, the bottom 428 of the recess 420 has no gaps, cutouts, or recesses formed therein.

It is understood that, alternatively, the plurality of abrasive segments 410 can comprise an abrasive layer and a backing layer used for attaching the abrasive segments 410 within the protruding flange 418 of the recess 420 of the core 414, as explained in greater detail above.

The plurality of abrasive segments 410 are also arcuate or arched along the longitudinal length $L^4$ an operable amount to fit within the recess 420. The width $W^4$ of the abrasive segment 410 is substantially equal to the recess 420 width such that there is substantially no gap between the side surfaces 424,426 of the plurality of abrasive segments 410 and opposing vertical sides 430,432 of the protruding flange 418. The outside radius $R_1$ and the inside radius $R_2$ of the plurality of abrasive segments 410 substantially correspond and, preferably, the outside radius $R_3$ and inside radius $R_4$ of the protruding flange 418 of the core 414 substantially correspond thereto and to one another. By way of example, $R_1$ can be about −0.05 mm and $R_2$ can be about +0.05 mm, and the like. Generally, the depth $D^4$ and width $W^4$ of the plurality of abrasive segments 410 is operable to form a cutting surface profile 416 therein and to accommodate re-truing or re-profiling and/or replacement of the plurality of abrasive segments 410. The thickness of the abrasive material can be substantially level across the width $W^4$ of the abrasive segments 410. It is further understood that at least two abrasive segments 410 are used.

The plurality of abrasive segments 410 are coupled with terminal ends 440,442 of adjacent segments 410 located adjacent to one another, preferably directly abutting against one another, about the recess 420 such that the segmented abrasive portion 408 forms a substantially continuous rim of abrasive segments 410 and cutting surface profiles 440 of the plurality of abrasive segments 410 align so that the workpiece can have continuous contact with the cutting surface profiles 416 while the wheel 400 rotates for grinding. The terminal ends 440,442 are also angled an operable amount so that adjacent of plurality of abrasive segments 410 can be located adjacent to one another, e.g., substantially with no gap therebetween, about the recess 420. It is understood that, alternatively, the plurality of abrasive segments 410 can be spaced apart about the recess 420, either substantially equally or irregularly spaced. It is further understood that the plurality of abrasive segments 410 are attached to at least the bottom 428 of the protruding flange 418 of the core 414 and, preferably, the terminal ends 440,442 of adjacent segments 410 are not additionally bonded to one another. The plurality of abrasive segments 410 have sufficient abrasive grit, shown generally at 444, to shape and contour the workpiece.

The plurality of abrasive segments 410 can be attached to the core 414 by laser welding and/or brazing the segments 410 within the recess 420 of the core 414, which helps to improve bond strength between the metal core 414 and plurality of abrasive segments 410 and allows more precise placement of the segments 410, as will be explained in greater detail below. In an alternative embodiment, the plurality of abrasive segments 410 are attached adjacent to one another about the core by adhering segments to the metal core using n an alternative embodiment, the plurality of abrasive segments 410 are attached adjacent to one another by adhering segments to the metal core using a thin adhesive layer, e.g., less than 3 millimeters thick.

Preferably, the plurality of abrasive segments 410 can have the cutting surface profile 416 formed therein along the longitudinal length $L^4$ of each segment 410 extending within the recess 420 and having a substantially flat profile across the width $W^4$ direction and sufficient abrasive grit 444 to shape and contour the workpiece. It is understood that the plurality of abrasive segments 410 can have any alternative cutting surface profile, e.g., convex, concave, Vee groove, and the like, suitable for grinding a glass or non-metallic workpiece.

By way of non-limiting example, twelve abrasive segments 410 in a 30 degree arc having an operable longitudinal length $L^4$ can be attached to the core 414 within the recess 420 to form the segmented abrasive portion 408 on the first and/or second planar side portions 404,406. It is understood that more or less abrasive segments 410 can be used. Preferably, at most the longitudinal length $L^4$ of the segments is about 52 mm. Preferably, the longitudinal length $L^4$ of the plurality of abrasive segments 410 are substantially equal. It is understood that it is within the contemplation of the present invention that, alternatively, at least one of the longitudinal lengths $L^4$ can be different.

Figure 17:
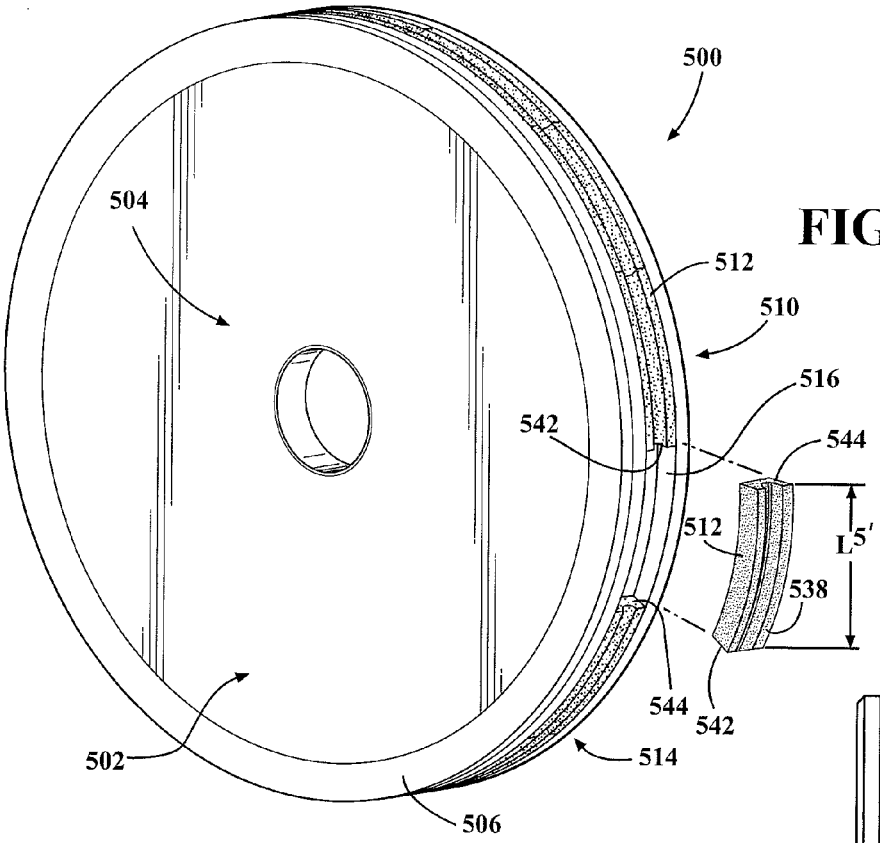
FIG. 17 is a perspective view of a segmented profiled wheel that is partially broken-away to depict an abrasive segment and recess, in accordance with another embodiment of the present invention.
Figure 19:
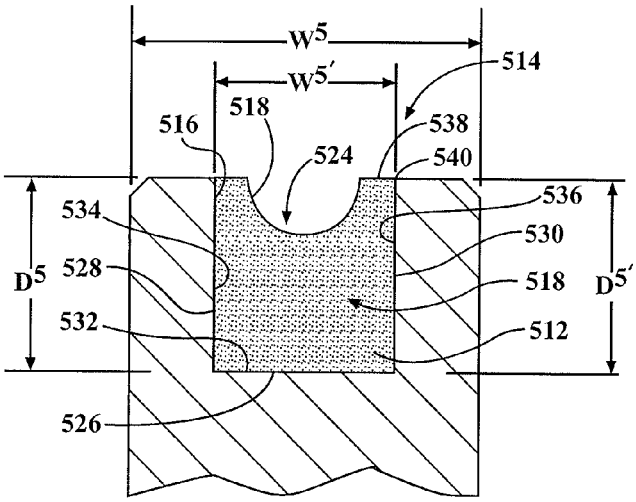
FIG. 19 is an enlarged cross sectional view of the segmented profiled wheel depicted in FIGS. 17-18, in accordance with the present invention.
Figure 18:
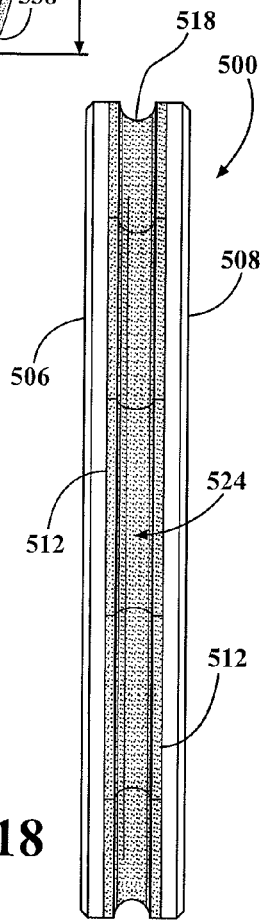
FIG. 18 is a top plan view of the segmented profiled wheel depicted in FIG. 17, in accordance with the present invention.

Referring to FIGS. 17-19 in general, in accordance with yet another embodiment of the present invention, there is provided a segmented profiled wheel shown generally at 500 for grinding a glass and/or non-metallic workpiece e.g., a glass table top edge, a retractable vehicle window glass, solar panels, and the like. The segmented profiled wheel 500, e.g., a pencil edging wheel for grinding a radius on a flat edge of a cut glass workpiece, includes a core 502 with a hub portion, shown generally at 504, operable for attachment to a rotary power source of a grinding machine, first and second radially extending planar side portions 506,508 that are substantially circular, and a segmented abrasive portion, shown generally at 510, comprising a plurality of abrasive segments 512.

The segmented profiled wheel 500 includes an outer circumferential surface, generally shown at 514, having a width $W^5$ and having a substantially centered recess 516, e.g., a squared off groove with a substantially planar bottom and vertical sides, formed therein that is a circumferential recess that extends to a depth $D^5$ operable to retain the segmented abrasive portion 510. The recess 516 is machined or otherwise formed into the core 502 along the outer periphery of the segmented profiled wheel 500 and the plurality of abrasive segments 512 of the segmented abrasive portion 510 are attached within the recess 516 and include sufficient abrasive grit, shown generally at 518, for profiling the glass or a non-metallic workpiece to give it the desired cross-section or form edge profile. FIG. 17 depicts the segmented profiled wheel 500 partially broken-away to illustrate a portion of the recess 516 and one of the plurality of abrasive segments 512 that fits therein.

The plurality of abrasive segments 512 have a width $W^{5'}$ substantially equal to the width of the recess 516 of the core 502 and can include a groove 518 formed therein along the entire longitudinal length $L^{5'}$ of each segment 512 extending in the circumferential direction and having a substantially U-shaped pencil edging profile and sufficient abrasive grit 518 to shape and contour the workpiece. The plurality of abrasive segments 512 are located adjacent to one another, preferably directly abutting against one another, to provide cutting surface profiles, shown generally at 524, about the periphery of the wheel 500 that are circumferentially aligned for grinding the workpiece when the wheel rotates. It is understood that the plurality of abrasive segments 512 can have any alternative cutting surface profile suitable for grinding. The core 502 is preferably a metal core, e.g., a substantially solid steel core comprising a hub portion with an arbor hole molded into it adapted for attachment to a rotary power source.

A bottom surface 526 and/or side surface(s) 528,530 of the plurality of abrasive segments 512 can have a squared off configuration with a substantially planar bottom and vertical sides. The bottom surface 526 and/or at least one side surface(s) 528,530 are attached within the recess 516 to a bottom 532 and/or at least one opposing sides internal vertical sides 534,536 of the recess 516. While a top surface 538 of the plurality of abrasive segments 512 is shown substantially flush with an opening 540 plane of the recess 516 it is understood that, alternatively, the plurality of abrasive segments 512 can extend partly through the opening 540 such that the top surface 538 is above the opening 540 outside of the recess 516. Preferably, the bottom surface 526 of the plurality of abrasive segments 512 is located against the bottom 532 of the recess 516 with no gap and the depth $D^{5'}$ of the plurality of abrasive segments 512 extends at least to the plane across the opening 540 of the recess 516. The squared off recess 516 and opposing squared off abrasive segment 512 configuration can further help to improve strength and stability of the plurality of abrasive segments 512. Preferably, the bottom 532 of the recess 516 has no gaps, cutouts, or recesses formed therein.

It is understood that, alternatively, the plurality of abrasive segments 512 can comprise an abrasive layer and a backing layer used for attaching the abrasive segments 512 within the recess 516 of the core 502, as explained in greater detail above.

The plurality of abrasive segments 512 are also arcuate or arched along the longitudinal length $L^{5'}$ an operable amount, e.g., by at least about 30 degrees, to fit within the circumferential recess 516. The width $W^{5'}$ is substantially equal to the recess 516 width such that there is substantially no gap between the side surfaces 528,530 of the plurality of abrasive segments 516 and opposing internal sides 534,536 of the recess 516. It is further understood that at least two abrasive segments 512 are used.

Generally, the depth $D^{5'}$ and width $W^{5'}$ of the plurality of abrasive segments 512 is operable to form the cutting surface profile 524 therein and to accommodate re-truing or re-profiling and/or replacement of the plurality of abrasive segments 512. By way of example, the recess 516 depth $D^5$ of a 200 mm wheel can be at least about 7.01 mm and the abrasive segment 512 depth $D^{5'}$ substantially equals the recess 516 depth $D^5$, and the width $W^{5'}$ of the abrasive segment 512 can be at least about 6.50 mm, which is substantially equal to width of the recess 516, such that the plurality of abrasive segments 512 can fit snuggly into the recess 516. By way of example, the width $W^{5'}$ of the abrasive segment 512 can accommodate the groove 518 formed therein that can have a depth of at least about 1.55 mm, width of at least about 4.06 mm, and a radius of at least about R2.11 mm. It is understood that the depth $D^{5'}$ can be operably greater than or less than about 7.01 mm. It is further understood that the width $W^{5'}$ can be operably greater than or less than about 6.50 mm.

The plurality of abrasive segments 512 are coupled with terminal ends 542,544 of adjacent segments 512 located adjacent to one another, preferably directly abutting against one another, about the recess 516 such that the segmented abrasive portion 510 forms a substantially continuous rim of abrasive segments 512 and cutting surface profiles 524 of the plurality of abrasive segments 512 align so that the workpiece can have continuous contact with the cutting surface profiles 524 while the wheel 500 rotates for grinding. The terminal ends 542,544 are also angled an operable amount so that adjacent of plurality of abrasive segments 512 can be located adjacent to one another, e.g., substantially with no gap therebetween, about the recess 516. By way of example the terminal ends 542,544 can be operably angled in the direction from the outermost surface of the segment toward the bottom surface 526 in opposing orientations relative to one another. It is understood that, alternatively, the plurality of abrasive segments 512 can be spaced apart about the recess 516, either substantially equally or irregularly spaced. It is further understood that the plurality of abrasive segments 512 are attached to at least the bottom 532 of the recess 512 of the core 502 and, preferably, the terminal ends 542,544 of adjacent segments 512 are not additionally bonded to one another.

The plurality of abrasive segments 512 can be attached to the core 502 by laser welding and/or brazing the segments 512 within the recess 516 of the core 502, which helps to improve bond strength between the metal core 502 and plurality of abrasive segments 512 and allows more precise placement of the segments 512, as will be explained in greater detail below. In an alternative embodiment, the plurality of abrasive segments 512 are attached adjacent to one another by adhering segments to the metal core using a thin layer of adhesives.

By way of non-limiting example, twelve abrasive segments 512 in a 30 degree arc having an operable longitudinal length $L^{5'}$ can be attached to the core 502 within the recess 516 to form the segmented abrasive portion 510. It is understood that more or less abrasive segments 510 can be used. Preferably, at most the longitudinal length $L^{5'}$ of the segments is about 52 mm. Preferably, the longitudinal length $L^{5'}$ of the plurality of abrasive segments 512 are substantially equal. It is understood that it is within the contemplation of the present invention that, alternatively, at least one of the longitudinal lengths $L^{5'}$ can be different.

Figure 20:
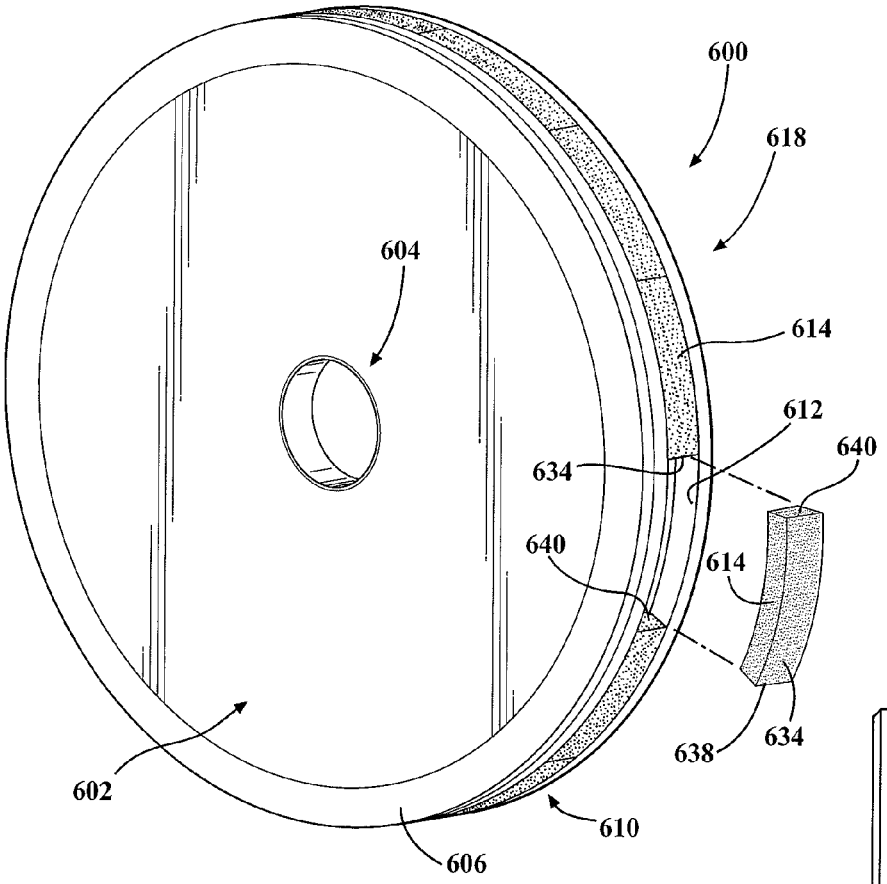
FIG. 20 is a perspective broken-away view of a segmented profiled wheel that is partially broken-away to depict an abrasive segment and recess, in accordance with another embodiment of the present invention.
Figure 21:
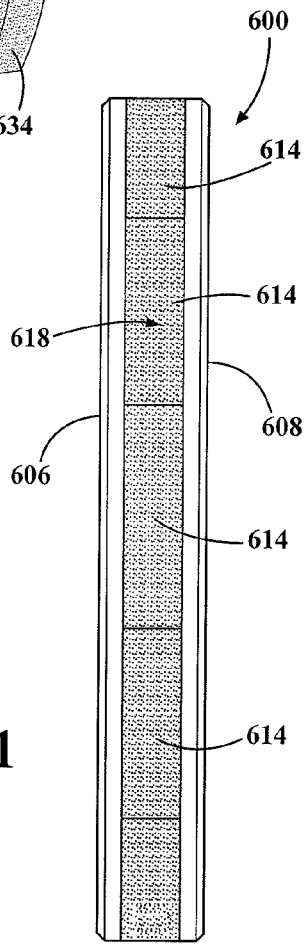
FIG. 21 is a top plan view of the segmented profiled wheel depicted in FIG. 20, in accordance with the present invention.

Referring to FIGS. 20-22, there is illustrated a segmented profiled wheel 600 in accordance with another embodiment of the present invention similar to the segmented profiled wheel 500 depicted in FIGS. 17-19, e.g., comprises a core 602 with a hub portion 604, first and second planar side portions 606,608, and an outer circumferential surface, generally shown at 610, having a width $W^6$ and having a substantially centered recess 612 formed therein, e.g., a squared off groove with a substantially planar bottom and vertical sides, formed therein that is a circumferential recess that extends to a depth $D^6$ operable to retain a segmented abrasive portion, shown generally at 618, therein.

The segmented abrasive portion 618 comprises a plurality of abrasive segments 614 having a cutting surface profile 616 that is substantially flat.

The cutting surface profile 616 extends along the longitudinal length $L^6$ of each of plurality of abrasive segments 612 and has a substantially flat profile across the width $W^{6'}$ direction and sufficient abrasive grit, shown generally at 620, at a sufficient depth $D^{6'}$ to shape and contour the workpiece. By way of example, the depth $D^{6'}$ can be at least about 2.5 to 5.0 mm and the width $W^{6'}$ can be at least about 6.6 mm. It is understood that the plurality of abrasive segments 614 can have any alternative cutting surface profile 616, e.g., convex, concave, and the like, suitable for grinding a glass or non-metallic workpiece. Generally, the depth $D^{6'}$ and width $W^{6'}$ of the plurality of abrasive segments 614 is operable to form the cutting surface profile 616 therein and to accommodate re-truing or re-profiling and/or replacement of the plurality of abrasive segments 614. It is understood that the depth $D^{6'}$ can be operably greater than or less than about 2.5 to 5.0 mm. It is further understood that the $W^{6'}$ can be operably greater than or less than about 6.6 mm.

The recess 612 is machined or otherwise formed into the core 602 along the outer periphery of the segmented profiled wheel 600 and the plurality of abrasive segments 614 of the segmented abrasive portion 618 are attached within the recess 612 and include sufficient abrasive grit 620 for profiling the glass or a non-metallic workpiece. FIG. 20 depicts the segmented profiled wheel 600 partially broken-away to illustrate a portion of the recess 612 and one of the plurality of abrasive segments 614 that fits therein.

A bottom surface 622 and/or side surface(s) 624,626 of the plurality of abrasive segments 614 can have a squared off configuration with a substantially planar bottom and vertical sides. The bottom surface 622 and/or at least one side surface(s) 624,626 are attached within the recess 612 to a bottom 628 and/or at least one opposing sides internal vertical sides 630,632 of the recess 612. While a top surface 634 of the plurality of abrasive segments 614 is shown substantially flush with an opening 636 plane of the recess 612 it is understood that, alternatively, the plurality of abrasive segments 614 can extend partly through the opening 636 such that the top surface 634 is above the opening 636 outside of the recess 612. Preferably, the bottom surface 622 of the plurality of abrasive segments 614 is located against the bottom 628 of the recess 612 substantially with no gap and the depth $D^{6'}$ of the plurality of abrasive segments 614 extends at least to the plane across the opening 636 of the recess 612. The squared off recess 612 and opposing squared off abrasive segment 614 configuration can further help to improve strength and stability of the plurality of abrasive segments 614. Preferably, the bottom 628 of the recess 612 has no gaps, cutouts, or recesses formed therein.

It is understood that, alternatively, the plurality of abrasive segments 614 can comprise an abrasive layer and a backing layer used for attaching the abrasive segments 614 within the recess 612 of the core 602, as explained in greater detail above.

The plurality of abrasive segments 614 are also arcuate or arched along the longitudinal length $L^6$ an operable amount, e.g., by at least about 30 degrees, to fit within the circumferential recess 612. The width $W^{6'}$ is substantially equal to the recess 612 width such that there is substantially no gap between the side surfaces 624,626 of the plurality of abrasive segments 614 and opposing internal vertical sides 630,632 of the recess 612. The thickness of the abrasive material can be substantially level across the width $W^{6'}$ of the abrasive segments 614. It is further understood that at least two abrasive segments 614 are used.

The plurality of abrasive segments 614 are located adjacent to one another, preferably directly abutting against one another, to provide cutting surface profiles 616 about the circumference of the wheel 600 that are circumferentially aligned for grinding the workpiece when the wheel rotates. It is understood that the plurality of abrasive segments 614 can have any alternative cutting surface profile suitable for grinding. The core 602 is preferably a metal core, e.g., a substantially solid steel core comprising a hub portion with an arbor hole molded into it adapted for attachment to a rotary power source and can be interchangeable.

The plurality of abrasive segments 614 are coupled with terminal ends 638,640 of adjacent segments 614 located adjacent to one another, preferably directly abutting against one another, about the recess 612 such that the segmented abrasive portion 618 forms a substantially continuous rim of abrasive segments 614 and cutting surface profiles 616 of the plurality of abrasive segments 614 align so that the workpiece can have substantially continuous contact with the cutting surface profiles 616 while the wheel 600 rotates for grinding. The terminal ends 638,640 are also angled an operable amount so that adjacent of plurality of abrasive segments 614 can be located adjacent to one another, e.g., substantially with no gap therebetween, about the recess 612. By way of example the terminal ends 638,640 can be operably angled in the direction from the outermost surface of the segment toward the bottom surface 622 in opposing orientations relative to one another. It is understood that, alternatively, the plurality of abrasive segments 614 can be spaced apart about the recess 612, either substantially equally or irregularly spaced. It is further understood that the plurality of abrasive segments 614 are attached to at least the bottom 628 of the recess 612 of the core 602 and, preferably, the terminal ends 638,640 of adjacent segments 614 are not additionally bonded to one another.

The plurality of abrasive segments 614 can be attached to the core 602 by laser welding and/or brazing the segments 614 within the recess 612 of the core 602, which helps to improve bond strength between the metal core 602 and plurality of abrasive segments 614 and allows more precise placement of the segments 614, as will be explained in greater detail below. In an alternative embodiment, the plurality of abrasive segments 614 are attached adjacent to one another by adhering segments to the metal core using adhesives.

By way of non-limiting example, twelve abrasive segments 614 in a 30 degree arc having an operable longitudinal length $L^6$ can be attached to the core 602 within the recess 612 to form the segmented abrasive portion 618. It is understood that more or less abrasive segments 618 can be used. Preferably, at most the longitudinal length $L^6$ of the segments is about 52 mm. Preferably, the longitudinal length $L^6$ of the plurality of abrasive segments 614 are substantially equal. It is understood that it is within the contemplation of the present invention that, alternatively, at least one of the longitudinal lengths $L^6$ can be different.

FIG. 23 depicts a segmented profiled wheel, shown generally at 700, according to another embodiment of the present invention illustrating a plurality of abrasive segments 702 that are attached spaced apart from one another to the peripheral surface 704 of the core, shown generally at 706, such that there are gaps or slots, shown generally at 708, between adjacent segments. Typically, the gaps 708 can be substantially equal and/or irregularly spaced. Preferably, the gaps 708 are substantially equal. It is understood that, alternatively, the plurality of abrasive segments 702 can be attached spaced apart from one another within a recess formed in a circumferential groove and/or first and/or second planar side portions of a wheel. It is further understood that the distance of the gap 708 can be greater or less than depicted in FIG. 23.

Figure 24:
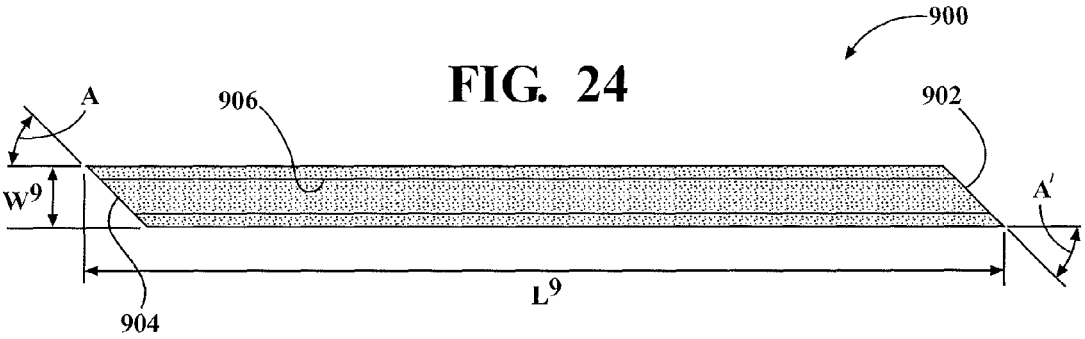
FIG. 24 is a top plan view of an abrasive segment depicted, in accordance with another embodiment of the present invention.
Figure 25:
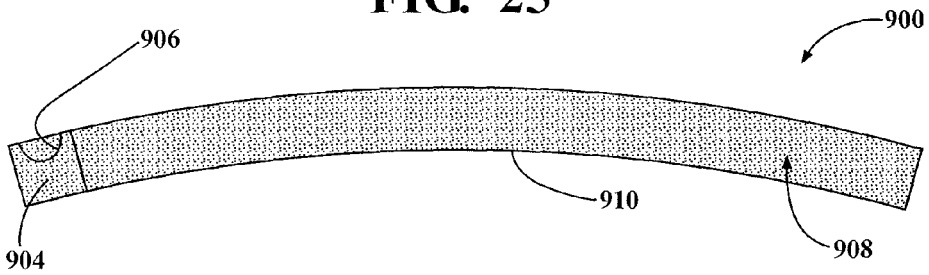
FIG. 25 is a front elevation view of the abrasive segment depicted in FIG. 25, in accordance with the present invention.

Referring to FIGS. 24-25 in general, an abrasive segment for a segmented profiled wheel in accordance with another embodiment of the present invention for grinding, is shown generally at 900. The abrasive segment 900 is similar to that depicted in FIGS. 1-23 and additionally has terminal ends 902,904 that are angled, depicted as angles A,A', across the width $W^9$ direction, e.g., terminal ends 902,904 that are substantially parallel to one another and are angled by about 45 degrees across the segment generally transverse to the direction of rotation of the wheel and/or the first and second planar side portions. Generally, the terminal ends 902,904 are angled by about 30 to 50 degrees. Preferably, the terminal ends 902,904 are angled by about 45 degrees. A plurality of abrasive segments 900 can be located adjacent to one another, e.g., substantially with no gap therebetween, about the periphery of the wheel core.

The abrasive segment 900 includes a groove 906 formed therein along the entire longitudinal length $L^9$ and has a substantially U-shaped pencil edging profile and sufficient abrasive grit, shown generally at 908, to shape and contour the workpiece. It is understood that any alternative cutting surface profile, e.g., substantially flat across the width $W^9$, Vee groove, and the like, suitable for grinding can be used, and/or can further comprise an abrasive layer and a non-diamond powdered metal backing material layer used for attaching the abrasive segments to the wheel core. The abrasive segment 900 is arcuate or arched along the longitudinal length $L^9$ an operable amount, such that the abrasive segment 900 can attach to at least one surface of the wheel core. Generally, the abrasive segment 900 can be, by example, arched by at least about 30 degrees.

The terminal ends 902,904 can additionally be angled an operable amount from the outermost surface of the segment toward a bottom surface 910. Generally, the terminal ends 902,904 can be angled by about 0.5 to 35 degrees. Typically, the terminal ends 902,904 can be angled by about 1 to 20 degrees. Preferably, the terminal ends 902,904 can be angled by about 5 to 10 degrees.

Figure 26:
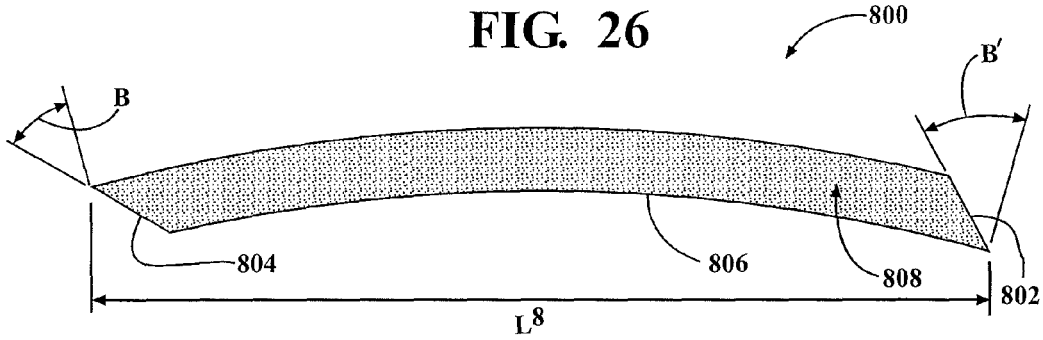
FIG. 26 is a front elevation view of an abrasive segment, in accordance with yet another embodiment of the present invention.

Referring to FIG. 26, an abrasive segment for a segmented profiled wheel in accordance with another embodiment of the present invention for grinding, is shown generally at 800. The abrasive segment 800 is similar to that depicted in FIGS. 1-25 and additionally has terminal ends 802,804 that are substantially parallel to one another and are angled an operable amount. Preferably, the terminal ends 802,804 can be operably angled, depicted as angles B,B', in the same direction substantially parallel to one another from the outermost surface of the segment toward the bottom surface 806. Generally, the terminal ends 802,804 are angled by about 30 to 50 degrees. Preferably, the terminal ends 802,804 are angled by about 45 degrees. A plurality of abrasive segments 800 can be located adjacent to one another, e.g., substantially with no gap therebetween, about the periphery of the wheel core.

The abrasive segment 800 can include a groove formed therein along the entire longitudinal length $L^8$ and have a substantially U-shaped pencil edging profile and sufficient abrasive grit, shown generally at 808, to shape and contour the workpiece. It is understood that any alternative cutting surface profile suitable for grinding can be used, e.g., substantially flat, Vee groove, and the like, and/or can further comprise an abrasive layer and a non-diamond powdered metal backing material layer used for attaching the abrasive segments to the wheel core. The abrasive segment 800 is arcuate or arched along the longitudinal length $L^8$ an operable amount, such that the abrasive segment 800 can attach to at least one surface of the wheel core. Generally, the abrasive segment 800 can be, by example, arched by at least about 30 degrees.

Referring to FIGS. 1-26 generally, the plurality of abrasive segments can comprise a diamond bonding mixture, e.g., powdered metal bonding matrix having diamonds mixed therein, iron powder bonding matrix with diamond, and the like. It is understood that, alternatively, the abrasive grit material can be comprised of a diamond-like hardness abrasive grit or other materials such as silicon carbides, tungsten carbides, oxides, garnets, cubic boron nitride, and natural and synthetic diamonds can be used alone or in combination in the present invention. Preferably, the plurality of abrasive segments comprises a powdered metal bonding matrix including diamond or diamond-like hardness material, which helps to significantly improve bond strength.

The exact grit rating of the abrasive grit is not thought to be critical to the success of the present invention provided that the abrasive grit material of the present invention is operable to grind the desired workpieces. In accordance with a preferred embodiment of the present invention, the grit rating of the abrasive grit material is preferably in the range of about 20 to about 80, more preferably in the range of about 60 to about 80, and still more preferably in the range of about 60 to about 70. It should be appreciated that grit rating outside of these ranges, e.g., less than 20 and/or greater than 80, may be used as well in the practice of the present invention, should circumstances require (e.g., material specific requirements).

Generally, the abrasive grit concentration and/or grit size of each abrasive segment can be substantially the same throughout the segment. Alternatively, the abrasive grit concentration and/or grit size of the abrasive segments can differ. Generally, at least about 15% of each abrasive segment is diamond or diamond like hardness material mixed therein. Typically, at least about 40% of each abrasive segment is diamond or diamond like hardness material mixed therein.

Generally, the surface area of the wheel comprised of the plurality of abrasive segments is at least about 45-100%. Typically, the surface area of the wheel comprised of the plurality of abrasive segments is at least about 50-75%. Preferably, the surface area of the wheel comprised of the plurality of abrasive segments is at least about 85-100%.

Generally, the terminal ends are angled an operable amount so that adjacent segments of the plurality of abrasive segments can be located adjacent to one another, e.g., substantially with no gap therebetween, about the periphery of the core and/or within the recess formed on the first and/or second planar side portion and or circumferential groove of the core. Generally, the terminal ends are angled by about 0.5 to 45 degrees. Typically, the terminal ends are angled by about 1 to 20 degrees. Preferably, the terminal ends are angled by about 5 to 10 degrees.

Additionally, it is understood that, optionally, recesses or grooves can be formed within at least the cutting surface profiles to help evacuate ground swarf from the grinding interface of the workpiece and the grooves and/or to supply grinding fluid to the grinding interface. By way of example, as the workpiece reaches the recesses, the ground workpiece swarf passes along the recesses and clears out through the first and/or second planar side portions. By way of example, as the workpiece reaches the recesses, the ground workpiece swarf clears the side of the workpiece and/or any grinding fluid can also reach the cutting surface interface.

In the alternative embodiment the plurality of abrasive segments can be attached adjacent to one another to the core by adhering segments to the metal core using an adhesive layer that has a predetermined thickness, e.g., suitable to allow a predetermined amount of spreading of the adhesive. Generally, the adhesive is about 2-6 thousands of an inch thick. Typically, the adhesive layer is about 4-6 thousands of an inch thick. Preferably, the adhesive layer is about 2-4 thousands of an inch thick. The plurality of abrasive segments can, by way of example, be applied and located more concisely using a fixture to add segments with adhesive, e.g., to index the segments within a recess of the core using non-water based adhesive on at least the bottom of the segment.

Preferably, the adhesive is not water based, e.g., a two-part epoxy-type thixotropic adhesive that is not water based, which improves the curing, strength, durability, chemical resistance, and overall grinding performance over conventional water-based adhesives. Typically, adhesives such as those currently marketed under the trade names Araldite® EP100AB Epoxy Adhesive (e.g., aerospace adhesive), Epibond® 420-A/B (e.g., structural epoxy adhesive), Epocast® 1636-A/B (e.g., epoxy syntactic), Araldite 2014® (e.g., structural adhesive) are used (all commercially available from Huntsman Advanced Materials, The Woodlands, Tex.). Preferably, a two component epoxy paste adhesive is used, such as the material currently marketed under the trade name Araldite 2014® (commercially available from Huntsman Advanced Materials, The Woodlands, Tex.). The adhesive can also advantageously be an electrical conductive adhesive, e.g., comprising metallic and/or conductive material filler, as will be explained in greater detail below.

It is understood that the segmented profiled grinding wheel can comprise an adhesive layer that is non-conductive, wherein an external electrical contact on the abrasive segments in proximity to the circumferential surface by an EDM electrode is used in profiling the diamond segments.

It should further be appreciated that the present invention can be practiced with any alternative type of surfacing wheels wherein segmented abrasive portions for reducing costs and improving performance is desirable. For example, the present invention can be applied to any number of types of surfacing wheels, such as but not limited to rough cutting wheels, fine grinding wheels, finishing wheels, polishing wheels, beveling wheels, pencil edging wheels, cup wheels, any metal bonding wheel, and the like. Additionally, the present invention can be practiced with any type of glass and non-metallic material, e.g., solar panels, optical lens blank material, glass, glass table top edges, retractable vehicle window glass, sandstone, marble, plastics and the like.

Referring to FIGS. 1-26 generally, and more specifically to FIGS. 1-5 and 8-11, in accordance with another embodiment of the present invention, a method of forming a segmented profiled wheel 10,200 includes a plurality of steps to help improve manufacturing costs and help improve the grinding performance and longevity of the wheel. The method comprises the steps of forming a plurality of abrasive segments 20,210 having a cutting surface profile 26,218 and sufficient abrasive grit 30,220 for profiling a glass or a non-metallic workpiece to give it the desired cross-section or form edge profile, forming a core 24,214, and attaching the plurality of abrasive segments 20,210 to the peripheral surface 22,212 of the core 24,214 to form a segmented abrasive portion 18,208. The method of the present invention can help to improve manufacturing, productivity, and material costs, help to improve strength, longevity, and re-truing or re-profiling, and/or replacement of the abrasive segments 20,210, and to help improve wheel cost and disposability.

A core blank, e.g., metal blank, can be machined and/or molded to form the core 24,214 comprising a hub portion 12,202 operable for attachment to a rotary power source, first and second radially extending planar side portions 14,16; 204,206, and the circumferential peripheral surface 22,212. The core 24,214 can be interchangeable for use with various new and/or replacement abrasive segment 20,210 profiles. The core 24,214 is preferably a metal core, e.g., a substantially solid steel core with an arbor hole formed into it adapted for attachment to a rotary power source. It is understood that, alternatively, the core 24,214 can be injection molded and/or lower cost materials can be used, e.g., such as plastic(s), aluminum, and the like, to help reduce manufacturing costs, wheel weight, and material costs.

A diamond bonding mixture can be processed to form the plurality of abrasive segments 20,210, e.g., powdered metal bonding matrix having diamonds mixed therein. It is understood that, alternatively, the abrasive grit material can be comprised of a diamond-like hardness abrasive grit or other materials such as silicon carbides, tungsten carbides, oxides, garnets, cubic boron nitride, and natural and synthetic diamonds can be used alone or in combination in the present invention. The plurality of abrasive segments 20,210 can be metal bonded segments. Preferably, the plurality of abrasive segments 20,210 comprises a powdered metal bonding matrix including diamond or diamond-like hardness material, which helps to significantly improve bond strength.

The plurality of abrasive segments 20,210 are formed in automated processes, e.g., including the mixing and dosing of the powders, and/or pressing, and/or cold pressing, and/or sintered diamond bonding using any suitable powder metal sintering process including free sintering or sintering within a mold or fixture, and/or induction heating, and/or brazing the segments, and/or laser welding, and the like, which can help to significantly reduce material, scrap, labor, machining and equipment costs, and to improve dimensional tolerances, processing time, and efficiency. To form the abrasive segment 20,210, diamonds can be mixed with a temporary binder and coated in metal, e.g., iron powder, powdered metal, and the like, to form a ball or ball-like shape that can be heated and sintered to place into a mold where it is at least pressed, e.g., cold pressed, at least once and heated, e.g., placed into an oven, and/or sintered by heating the material at least once, all of which are automated steps. It is understood that processing can include induction heating and brazing forming the metal bonded abrasive segment.

In accordance with one embodiment, the plurality of abrasive segments 20,210, e.g., metal bonded diamond abrasive segments, are made by cold press and free sintering. In another embodiment, the abrasive segments are made by cold pressing the segment material to a graphite mold using vacuum, applying resistance heating to heat the uniform graphite mold, and the segments are hot pressed or hot coined in the graphite mold.

In accordance with one embodiment, a metal bonded diamond abrasive segment is cold pressed and heated in an oven. In another embodiment, the abrasive segments are made by cold pressing, e.g., vacuum, heating in a uniform graphite mold by heating the mold using resistant heat, and then hot pressing or hot coining the segment in the mold.

Generally, the finished abrasive segments 20,210 from the mold have their final form and finished dimensions, including the arcuate shape to attach to the peripheral surface 22, 212 of the core 24,214, and the cutting surface profile 26,218 formed therein, e.g., comprising a groove with a U-shaped pencil edging profile, a substantially flat profile, and the like, for grinding the workpiece when the wheel rotates. The cutting surface profile 218 can be substantially flat, e.g., as depicted in FIGS. 8-11. The wheel shown in FIGS. 1-5 depicts a groove 28 formed in the abrasive segments 20 during the automated processing that has a cutting surface profile 26 that is U-shaped. It is understood that, alternatively, any operable shape suitable for grinding can be formed. Typically, minimal or no secondary operations are required to shape or otherwise finish the abrasive segments 20,210. Preferably, at most, minimal final truing of the segment 20,210 is needed after the automated processes, e.g., to remove a thin lip or bur of material from the end(s) of the U-shaped groove 26 and/or to grind the angle of the terminal ends 34,36,224,226 of the abrasive segments 20,210 if desired. Any secondary machining operation, e.g., angling terminal ends 34,36,224,226, can use grinding, EDM, and the like.

One of the benefits of the method of forming the plurality of abrasive segments 20,210 of the present invention is that it helps to create tighter dimensional tolerances of the cutting surface profiles 26,218 than conventional methods. Another of the benefits is that the present method reduces expensive material scrap since cutting surface profiles 26,218 of the present invention are not created by grinding out abrasive grit material, e.g., after cold pressing and heating in a mold, and/or using stints and the like. Conversely, conventional methods waste at least about 25% of the abrasive grit material when grinding out profiles, e.g., U-shaped profiles, and requires increased labor and equipment.

The plurality of abrasive segments 20,212 are attached to the peripheral surface 22,212 of the core 24,214 by laser welding and/or metallic braze welding. One of the benefits of laser welding or metallic braze welding abrasive segments 20,212, e.g., comprised of powdered metal bonding material with diamond mixed therein, to the metal core 24,214 is that it helps to improve bond strength, which is disadvantageously weak in known conventional wheels. The plurality of abrasive segments 20,212 can additionally be located more precisely and are attached to the core 24,214 adjacent to one another with cutting surface profiles 26,218 extending in the circumferential direction forming a segmented abrasive portion 18,208 about the periphery of the core 24,214 that is a substantially continuous rim of abrasive segments 20,210 for the workpiece to have continuous contact with the cutting surface profile 26,218, e.g., within the groove 28 profile, while the wheel rotates for grinding. In an alternative embodiment, the plurality of abrasive segments 20,212 are attached adjacent to one another about the core by adhering segments to the metal core using adhesives. Preferably, terminal ends 34,36,224, 226 of adjacent abrasive segments 20,212 directly abut against one another substantially with no gaps therebetween. It is understood that, alternatively, the plurality of abrasive segments 20,212 can be spaced apart about the periphery of the core 24,214, either substantially equally or irregularly spaced.

It is understood that, alternatively, the plurality of abrasive segments 20,210 can be attached to the core 24,214 by mechanically clamping into a reusable core fixture. Alternatively, the plurality of abrasive segments 20,210 can be placed within a mold so that the abrasive segments 20,210 form a rim of segmented abrasive portion 18,208, e.g., of a 200 mm diameter pencil edging wheel, and a resinous material is compressed around the abrasive segments 20,210 to form a body or core 24,214 that has the arbor hole molded into it, during a compression molding process.

It is understood that, alternatively, the plurality of abrasive segments 20,212 can be formed to create an abrasive layer and a backing layer used for attaching the abrasive segments 20,212 to the peripheral surface 22,212 of the core 24,214, as explained in greater detail below.

The method of forming the segmented profiled wheel 100 of FIGS. 6-7 is similar, e.g., comprises forming a plurality of abrasive segments 110 having a cutting surface profile and sufficient abrasive grit for profiling a glass or a non-metallic workpiece to give it the desired cross-section or form edge profile, forming a core comprising a hub 102, and attaching the plurality of abrasive segments 110 to the peripheral surface of the core to form a segmented abrasive portion 108. FIGS. 6-7 illustrate the plurality of abrasive segments 110 having a depth D' that is operably thicker e.g., to allow a deeper circumferential groove to be formed therein and/or to help increase the number of times the plurality of abrasive segments 110 can be re-trued or re-profiled. It is understood that the depth D' can be any depth suitable for grinding and/or allowing re-truing or re-profiling of the plurality of abrasive segments 110.

Referring to FIGS. 1-26 generally, and more particularly to FIGS. 12-14, in accordance with another embodiment of the present invention, the method of forming the segmented profiled wheel 300 is similar to the segmented profiled wheel 10,100,200 of FIGS. 1-11 described in greater detail above with the aforementioned benefits, e.g., comprises forming a plurality of abrasive segments 310 having a cutting surface profile 316 and sufficient abrasive grit 324 for profiling a glass or a non-metallic workpiece to give it the desired cross-section or form edge profile, forming a core and attaching the plurality of abrasive segments 310 to the peripheral surface 312 of the core 314, e.g., by laser welding or brazing, to form a segmented abrasive portion 308. In addition, the plurality of abrasive segments 310 comprises an abrasive layer 318 and a backing layer 320. The backing layer 320 is a non-diamond powdered metal backing material layer used for attaching the abrasive segments 310 to the core 314.

Preferably, the abrasive layer 318 comprises a powdered metal bonding matrix with diamonds mixed therein and the backing layer 320 comprises a non-diamond powdered metal matrix, to improve bond strength. The backing layer 320 can comprise substantially the same powdered metal bonding matrix, or comparable, as the abrasive layer 318, but without the diamonds mixed therein. It is understood that, alternatively, the abrasive grit material can be comprised of a diamond-like hardness abrasive grit or other materials such as silicon carbides, tungsten carbides, oxides, garnets, cubic boron nitride, and natural and synthetic diamonds can be used alone or in combination mixed with the powdered metal.

The core 314 is formed similar to core 24,214, as explained in greater detail above, and the abrasive layer 318 of the plurality of abrasive segments 310 can be formed similarly as the abrasive segments 20,212, e.g., such that forming the abrasive layer 318 comprises automated processes as explained in greater detail above, e.g., including the mixing and dosing of the powders, and/or pressing, and/or cold pressing, and/or sintered diamond bonding using any suitable powder metal sintering process including free sintering or sintering within a mold or fixture, and/or induction heating, and/or brazing the segments, and/or laser welding, and the like. The automated processes can include mixing diamonds with a temporary binder and coating them in metal, e.g., iron powder, powdered metal, and the like, to form a ball or ball-like shape that can be heated and sintered to place into a mold where it is pressed, e.g., cold pressed, at least once and heated, e.g., placed into an oven. The backing layer 320 can be formed in similar automated processes but without the diamonds mixed therein. In accordance with one embodiment, a metal bonded diamond abrasive segment is cold pressed and heated in an oven. In another embodiment, the abrasive segments are made by cold pressing, e.g., vacuum, heating in a uniform graphite mold by heating the mold using resistant heat, and then hot pressing or hot coining the segment in the mold.

Generally, the finished abrasive layer 318 and backing layer 320 from the mold have their final form, including the arcuate shape to attach to one another and to the peripheral surface 312 of the core 314 and has the cutting surface profile 316 formed in the abrasive layer 318, e.g., comprising a groove with a U-shaped pencil edging profile, a substantially flat profile, and the like, for grinding the workpiece when the wheel rotates. The abrasive layer 318 is attached to the backing layer 320 to form the abrasive segment 310. Preferably, the abrasive layer 318 can be attached to the backing layer 320 by laser welding and/or brazing. The wheel shown in FIGS. 12-13 depicts a groove 322 formed in the abrasive segments 310 during the automated processing that has a cutting surface profile 316 that is U-shaped. It is understood that, alternatively, any operable shape suitable for grinding can be formed. Typically, minimal or no secondary operations are required to shape or otherwise finish the abrasive segments 310. Preferably, at most, minimal final dressing of the segment 310 is needed after the automated processes, e.g., to remove a thin lip or bur of material from the end(s) of the U-shaped groove 322 and/or to grind the angle of the terminal ends 336,338 of the abrasive segments 310. Any secondary machining operation, e.g., angling terminal ends 336,338, can use grinding, EDM, and the like. The cutting surface profile 356 can, alternatively, be substantially flat, e.g., as depicted in the FIG. 14 embodiment formed by a similar method.

The next step is to attach the backing layer 320 to the core 314, preferably, by laser welding and/or metallic bonding braze welding to the peripheral surface 312 of the core 314, which helps to improve bond strength between the metal core 314 and plurality of abrasive segments 310 and allows more precise placement of the segments. In an alternative embodiment, the plurality of abrasive segments 310 are attached adjacent to one another about the core by adhering segments to the metal core using adhesives. The plurality of abrasive segments 310 are attached to the core 314 adjacent to one another, preferably, directly abutting against one another substantially with no gaps therebetween. It is understood that, alternatively, the plurality of abrasive segments 310 can be spaced apart about the peripheral surface 312 of the core 314, either substantially equally or irregularly spaced.

It is understood that, alternatively, the plurality of abrasive segments 310 can be attached to the core 314 by mechanically clamping into a reusable core fixture. Alternatively, the plurality of abrasive segments 310 can be placed within a mold so that the abrasive segments 310 form a rim of segmented abrasive portion 310, e.g., of a 200 mm diameter pencil edging wheel, and a resinous material is compressed around the abrasive segments 310 to form a body or core 314 that has the arbor hole molded into it, during a compression molding process.

Referring to FIGS. 1-26 generally, and more particularly to FIGS. 15-16, in accordance with another embodiment of the present invention, the method of forming the segmented profiled wheel 400, e.g., a cup wheel, is similar to the segmented profiled wheel 10,100,200,300 of FIGS. 1-14 described in greater detail above, e.g., comprises forming a plurality of abrasive segments 410 having a cutting surface profile 416 and sufficient abrasive grit 444 for profiling a glass or a non-metallic workpiece to give it the desired cross-section or form edge profile, forming a core 414 including first and second planar side portions 404,406 and attaching the plurality of abrasive segments 410 to the core 414 to form a segmented abrasive portion 408. In addition, the plurality of abrasive segments 410 are attached within a recess 420 formed on the first and/or second planar side portions 404,406 of the core 414; not to the outer peripheral surface of the core 414.

Preferably, the plurality of abrasive segments 410 comprises a powdered metal diamond bonding mixture. It is understood that, alternatively, the abrasive grit material can be comprised of a diamond-like hardness abrasive grit or other materials such as silicon carbides, tungsten carbides, oxides, garnets, cubic boron nitride, and natural and synthetic diamonds can be used alone or in combination mixed with the powdered metal. It is understood that, alternatively, the plurality of abrasive segments 410 can comprise an abrasive layer and a backing layer used for attaching the abrasive segments 410 within the recess 420 of the protruding flange 418 of the core 414, as explained in greater detail above. The backing layer can comprise substantially the same metal bonding mixture as the abrasive layer, but without the diamonds and/or other abrasive grit mixed therein.

A core blank can be machined and/or molded to form the core 414 comprising a hub portion 402, first and second planar side portions 404,406, and a protruding flange 418 that can form a continuous outward protruding flange with a recess 420 formed therein located toward the outside edge on the first and/or second planar side portions 404,406. It is understood that, alternatively, the core 414 can be injection molded and/or use lower cost materials, e.g., such as aluminum, and the like, to help reduce manufacturing costs, wheel weight, and material costs.

The plurality of abrasive segments 410 can be formed using automated processes similar as the abrasive segments 20,110,212, e.g., such that forming the abrasive portion 408 comprises automated processes as explained in greater detail above, e.g., including the mixing and dosing of the powders, and/or pressing, and/or cold pressing, and/or sintered diamond bonding using any suitable powder metal sintering process including free sintering or sintering within a mold or fixture, and/or induction heating, and/or brazing the segments, and/or laser welding, and the like. The automated processes can include mixing diamonds with a temporary binder and coating them in metal, e.g., iron powder, powdered metal, and the like, to form a ball or ball-like shape that can be heated and sintered to place into a mold where it is at least pressed, e.g., cold pressed, at least once and heated, e.g., placed into an oven, or sintered by heating the material at least once. In accordance with one embodiment, a metal bonded diamond abrasive segment is cold pressed and heated in an oven. In another embodiment, the abrasive segments are made by cold pressing, e.g., vacuum, heating in a uniform graphite mold by heating the mold using resistant heat, and then hot pressing or hot coining the segment in the mold.

Preferably, at most, minimal final truing of the segment 410 is needed after the automated processes. The cutting surface profile 416 is depicted as substantially flat. It is understood that, alternatively, any operable shape suitable for grinding can be used.

The plurality of abrasive segments 410 extend laterally through an opening 436 and are attached inside the recess 420 of the protruding flange 418 of the core 414 by laser welding and/or metallic braze welding such that a bottom surface 422 and/or at least one side surface(s) 424,426 of the plurality of abrasive segments 410 are attached within the recess 420 to a bottom 428 and/or at least one opposing vertical side(s) 430, 432 of the protruding flange 418 substantially with no gaps. The top surface 434 of the abrasive segment 410 can be substantially flush with the recess opening 436. It is understood that, alternatively, the plurality of abrasive segments 410 can be attached to the core 414 by mechanically clamping into a reusable core fixture. Alternatively, the plurality of abrasive segments 410 can be placed within a mold so that the abrasive segments 410 form a rim of segmented abrasive portion 408 and a resinous material is compressed around the abrasive segments 410 to form a body or core 414 that has the arbor hole molded into it, during a compression molding process. In an alternative embodiment, the plurality of abrasive segments 410 are attached adjacent to one another inside the core recess 420 by adhering segments to the metal core using adhesives.

The plurality of abrasive segments 410 are attached to the core 414 adjacent to one another with cutting surface profiles 416 aligning about the first and/or second planar side portions 404,406 forming the segmented abrasive portion 408 that is a substantially continuous rim of abrasive segments 410 for the workpiece to have substantially continuous contact with the cutting surface profile 416 while the wheel rotates for grinding. Preferably, terminal ends 440,442 of adjacent abrasive segments 410 directly abut against one another substantially with no gaps therebetween. It is understood that, alternatively, the plurality of abrasive segments 410 can be spaced apart in the recess 420 on the first and/or side portions 404,406 of the core 410, either substantially equally or irregularly spaced. The cutting surface profiles 416 can be substantially transverse to a plane passing along the width direction of the peripheral surface of the wheel 400.

Referring to FIGS. 1-26 generally, and more particularly to FIGS. 17-19, in accordance with another embodiment of the present invention, the method of forming the segmented profiled wheel 500 is similar to the segmented profiled wheel 10,100,200,300,400 of FIGS. 1-16 described in greater detail above, e.g., comprises forming a plurality of abrasive segments 512 having a cutting surface profile 524 and sufficient abrasive grit 518 for profiling a glass or a non-metallic workpiece to give it the desired cross-section or form edge profile, forming a core 502 including first and second planar side portions 506,508 and attaching the plurality of abrasive segments 512 to the core 502 to form a segmented abrasive portion 510. In addition, the plurality of abrasive segments 512 are attached within a recess 516 formed in the outer circumferential surface 514 of the core 502.

Preferably, the plurality of abrasive segments 512 comprises a powdered metal diamond bonding mixture. It is understood that, alternatively, the abrasive grit material can be comprised of a diamond-like hardness abrasive grit or other materials such as silicon carbides, tungsten carbides, oxides, garnets, cubic boron nitride, and natural and synthetic diamonds can be used alone or in combination mixed with the powdered metal. It is understood that, alternatively, the plurality of abrasive segments 512 can comprise an abrasive layer and a backing layer used for attaching the abrasive segments 512 within the recess 516, as explained in greater detail above. The backing layer can comprise substantially the same metal bonding mixture as the abrasive layer, but without the diamonds and/or other abrasive grit mixed therein.

A core blank can be machined and/or molded to form the core 502 comprising a hub portion 504, first and second planar side portions 506,508, and the outer circumferential surface 514 with the recess 516 formed therein. It is understood that, alternatively, the core 502 can be injection molded and/or use lower cost materials, e.g., such as aluminum, and the like, to help reduce manufacturing costs, wheel weight, and material costs. The recess 516 is machined or otherwise formed into the core 502 along the outer periphery of the segmented profiled wheel 500 and the plurality of abrasive segments 512 of the segmented abrasive portion 510 are attached within the recess 516 and include sufficient abrasive grit, shown generally at 518, for profiling the glass or a non-metallic workpiece to give it the desired cross-section or form edge profile The plurality of abrasive segments 512 can be formed using automated processes similar as the abrasive segments 20,110,212,410 e.g., such that forming the abrasive portion 510 comprises automated processes as explained in greater detail above, e.g., including the mixing and dosing of the powders, and/or pressing, and/or cold pressing, and/or sintered diamond bonding using any suitable powder metal sintering process including free sintering or sintering within a mold or fixture, and/or induction heating, and/or brazing the segments, and/or laser welding, and the like. The automated processes can include mixing diamonds with a temporary binder and coating them in metal, e.g., iron powder, powdered metal, and the like, to form a ball or ball-like shape that can be heated and sintered to place into a mold where it is at least pressed, e.g., cold pressed, at least once and heated, e.g., placed into an oven, or sintered by heating the material at least once. In accordance with one embodiment, a metal bonded diamond abrasive segment is cold pressed and heated in an oven. In another embodiment, the abrasive segments are made by cold pressing, e.g., vacuum, heating in a uniform graphite mold by heating the mold using resistant heat, and then hot pressing or hot coining the segment in the mold. A groove 518 is formed in the abrasive segments 20 during the automated processing that has a cutting surface profile 524 that is U-shaped. It is understood that, alternatively, any operable shape suitable for grinding can be formed. Preferably, at most, minimal final truing of the segment 512 is needed after the automated processes.

The plurality of abrasive segments 512 extend into the recess 516 and are attached inside the recess 516 of the core 502 by laser welding and/or metallic braze welding such that a bottom surface 526 and/or at least one side surface(s) 528, 530 of the plurality of abrasive segments 512 are attached within the recess 516 to a substantially planar bottom 532 and/or at least one opposing vertical side(s) 534,536 of the recess 615 substantially with no gaps. The top surface 538 of the plurality of abrasive segments 512 can be substantially flush with the recess opening 540. In an alternative embodiment, the plurality of abrasive segments 512 are attached adjacent to one another inside the core recess 516 by adhering segments to the metal core using adhesives. It is understood that, alternatively, the plurality of abrasive segments 512 can be attached to the core 502 by mechanically clamping into a reusable core fixture. Alternatively, the plurality of abrasive segments 512 can be placed within a mold so that the abrasive segments 512 form a rim of segmented abrasive portion 510 and a resinous material is compressed around the abrasive segments 512 to form a body or core 502 that has the arbor hole molded into it, during a compression molding process.

The plurality of abrasive segments 512 are attached to the core 502 adjacent to one another with cutting surface profiles 524 circumferentially aligning about the wheel forming the segmented abrasive portion 510 that is a substantially continuous circumferential rim of abrasive segments 512 for the workpiece to have substantially continuous contact with the cutting surface profile 512, e.g., within the U-shaped pencil edging profile, while the wheel rotates for grinding. Preferably, terminal ends 542,544 of adjacent abrasive segments 512 directly abut against one another substantially with no gaps therebetween. It is understood that, alternatively, the plurality of abrasive segments 512 can be spaced apart about the periphery of the core 502, either substantially equally or irregularly spaced.

Referring to FIGS. 1-26 generally, and more particularly to FIGS. 20-22, in accordance with another embodiment of the present invention, the method of forming the segmented profiled wheel 600 is similar to the segmented profiled wheel 500 of FIGS. 17-19 described in greater detail above, e.g., comprises forming a plurality of abrasive segments 614 using automated processes having the arcuate shape and dimensions, cutting surface profile 616, and sufficient abrasive grit 620 for profiling a glass or a non-metallic workpiece to give it the desired cross-section or form edge profile, forming a core 602 including a hub portion 604 operable for attachment to a rotary power source, first and second planar side portions 606,608, and an outer circumferential surface 610 having a recess 612, and attaching the plurality of abrasive segments 614 within the recess 612 of the core 602 to form a segmented abrasive portion 618. However, the cutting surface profile 616 is substantially flat. It is understood that, alternatively, the plurality of abrasive segments 614 can have any alternative cutting surface profile 616, e.g., convex, concave, angled, slanted and the like, suitable for grinding a glass or non-metallic workpiece.

Referring to FIGS. 1-26 generally, and more particularly to FIG. 23, in accordance with another embodiment of the present invention, the method of forming the segmented profiled wheel 700 is similar to the segmented profiled wheel described in greater detail above, and further comprises attaching the plurality of abrasive segments 702 spaced an operable distance apart about the peripheral surface 704 of the core, e.g., substantially equally spaced.

Referring to FIGS. 1-26 generally, and more particularly to FIGS. 24-25, in accordance with another embodiment of the present invention, the method of forming the segmented profiled wheel is similar to the segmented profiled wheel described in greater detail above, and further comprises forming abrasive segments 900 that have terminal ends 902,904 that are additionally angled an operable amount across the width $W^9$ direction, e.g., substantially equal angles A,A' of at least about 45 degrees and substantially parallel ends 902,904 to one another in the direction generally transverse to the direction of rotation of the wheel across the width W9 of the segment 900. A groove 906 can be formed along the entire longitudinal length L9 of the segment 900 and can have a substantially U-shaped pencil edging profile and sufficient abrasive grit to shape and contour the workpiece. The abrasive segment 900 can be, by example, arched by at least about 30 degrees and have a bottom surface 910 wherein at least the bottom surface 910 can be coupled to the attachment surface(s), e.g., planar peripheral surface, channel, and the like, of the core and sufficient abrasive grit 908 for grinding.

Referring to FIGS. 1-26 generally, and more particularly to FIG. 26, in accordance with another embodiment of the present invention, the method of forming the segmented profiled wheel is similar to the segmented profiled wheel described in greater detail above, and further comprises forming abrasive segments 800 that have terminal ends 802,804 that are angled an operable amount and additionally are substantially parallel to one another, e.g., substantially equal angles B,B' of at least about 45 degrees and substantially parallel ends 802,804 to one another in the direction from the attachment surface of core across the depth of the segment 800. A groove can be formed along the longitudinal length L8 of the segment 800. The abrasive segment 800 can be, by example, arched by at least about 30 degrees and have a bottom surface 806 that can be coupled to the attachment surface(s), e.g., planar peripheral surface, channel, and the like, of the core and sufficient abrasive grit 808 for grinding.

Referring to FIGS. 1-27 generally, any adhesive used to attach the plurality of abrasive segments to the core can also advantageously be an electrical conductive adhesive. It is well known that there has long been two common issues in the metal bonded diamond wheel industry: (1) Typical pencil edging wheels must be profiled with EDM at some point in their life cycle, either during the manufacturing process or when the profile has worn out of tolerance and re-profiling is desired; and (2) an amount, e.g., 20 percent, of metal bonded diamond grinding wheels which are not pencil edging wheels must be either profiled using EDM or are used in an electrochemical grinding process. Thus, electrical conductivity from the core to the surface of the segmented abrasive portion is required to address these factors. There is a great and long-felt need in the industry for electrically conductive wheels that can, for example, be re-profiled by pencil edging wheel users using the users' conventional EDM processing. If a non-conductive method of mounting the segments to the core is used in accordance with an embodiment of the present invention, it is within the contemplation of this invention that an innovative conductive brush setup using a metal conductive mesh or a graphite contact brush contact on the periphery of the diamond section near to the EDM work electrode which provides the electrical continuity required can be used. In accordance with another embodiment of the present invention, the method of forming the segmented profiled grinding wheel further comprises adding metallic or conductive material filler to the adhesive suitable to provide electrical conductivity. Glass micro-spheres can additionally be added to the adhesive mixture operable to promote flow of the adhesive in the bonding area. In accordance with the present invention, it is found to be advantageous to use spherical shaped filler(s) that can enhance the predetermined flow of the adhesive across all areas required to be adhered to the core, while providing electrical conductivity.

Figure 27:
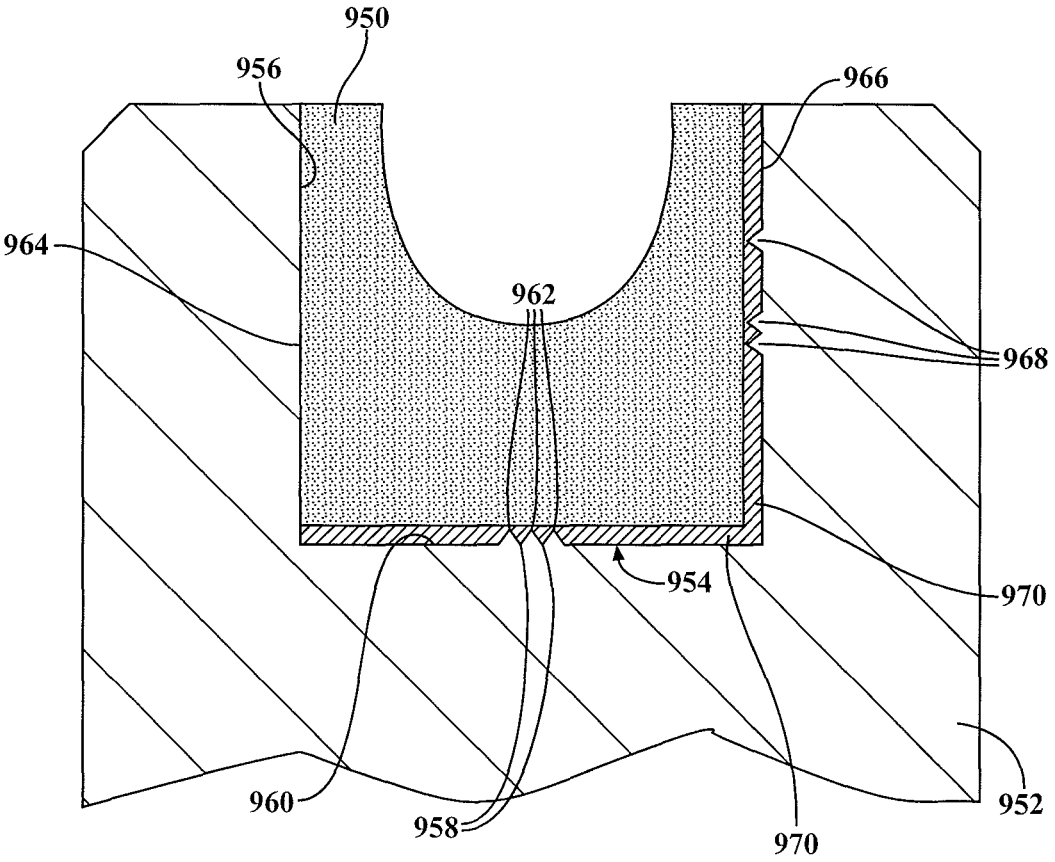
FIG. 27 is a cross sectional view of a segmented profiled wheel, in accordance with another embodiment of the present invention.

Referring to FIGS. 1-27 generally, and more particularly to FIG. 27, the abrasive segments 950 can also be electrically conductive through the core 952 by forming attachment surfaces with projections, ridges, points, and the like protuberances. The attachment surfaces, shown generally at 954, contact the abrasive segment 950 whereby continuity will be made. For example, knurling the bottom 960 of the recess or channel 956 formed in the core 952 or any other surface, e.g., the peripheral surface of the core that the abrasive segments are attached to with a non-conductive or conductive adhesive. By way of example, knurling the attachment surface can form a diamond-like shaped repeating criss-cross pattern of grooves with a plurality of peaks 962. Circumferential grooves 958 can be cut at the bottom 960 of the channel 956 that the abrasive segment 950 fits into and the peaks 962 of the grooved channel surface are formed to a sharp edge so that when the abrasive segment is adhered and held in place the edge of the peak 962 makes electrical contact with the segment 950. Alternatively, at least one of the walls 964,966 of the circumferential groove 958 could be knurled or have radial ribs 968 at predetermined places, which can cause the groove 958 to be smaller than the width of the segments 950 so when the segment 950 is pressed and adhered in place an electrical connection is made between the segment 950 and the core 952. In all of these examples and other possible configurations, the adhesive 970 can be conductive or non-conductive.

The description of the invention is merely exemplary in nature and, thus, variations that do not depart from the essence of the invention are intended to be within the scope of the invention. Such variations are not to be regarded as a departure from the spirit and scope of the invention.

What is claimed is:

1. A segmented profiled grinding wheel, comprising:

a core having a portion operable for attachment to a rotary power source;

radially extending first and second planar side portion; and a segmented abrasive portion attached to said core comprising a plurality of abrasive segments located adjacent to one another on said core, said plurality of abrasive segments comprising a cutting surface profile extending along a longitudinal length of each abrasive segment and a powdered metal bonding matrix with sufficient abrasive grit for grinding;

wherein said plurality of abrasive segments are attached to said core by adhering said segments to said core using adhesive, wherein said adhesive is electrical conductive adhesive.

2. The segmented profiled grinding wheel of claim 1, wherein said powdered metal bonding matrix further comprises sufficient diamond or diamond hardness abrasive grit mixed therein.

3. The segmented profiled grinding wheel of claim 1, wherein said plurality of abrasive segments further comprise terminal ends directly abutting against one another substantially with no gaps therebetween and said cutting surface profiles align for substantially continuous contact with a workpiece while said wheel rotates.

4. The segmented profiled grinding wheel of claim 1, wherein said plurality of abrasive segments further comprise terminal ends that are angled an operable amount and are substantially parallel to one another.

5. The segmented profiled grinding wheel of claim 1, wherein said plurality of abrasive segments further comprise terminal ends that are substantially parallel to one another and angled an operable amount across each segment width.

6. The segmented profiled grinding wheel of claim 1, wherein said plurality of abrasive segments further comprise a groove forming said cutting surface profile, wherein said cutting surface profile is U-shape.

7. The segmented profiled grinding wheel of claim 1, wherein said plurality of abrasive segments further comprise a groove forming said cutting surface profile, wherein said cutting surface profile is any shape.

8. The segmented profiled grinding wheel of claim 1, wherein said cutting surface profile is substantially flat.

9. The segmented profiled grinding wheel of claim 1, further comprising a peripheral surface that is substantially planar across its width and adjacent said first and second planar side portions, wherein said segmented abrasive portion is attached to said planar surface.

10. The segmented profiled grinding wheel of claim 1, further comprising a flange having a recess located on said first and/or second planar side portions, wherein said plurality of abrasive segments are attached within said recess.

11. The segmented profiled grinding wheel of claim 1, further comprising an outer circumferential surface having a substantially centered recess formed therein, wherein said plurality of abrasive segments are attached within said recess.

12. The segmented profiled grinding wheel of claim 1, wherein said plurality of abrasive segments have substantially equal longitudinal lengths.

13. The segmented profiled grinding wheel of claim 1, wherein said plurality of abrasive segments are substantially equally spaced.

14. The segmented profiled grinding wheel of claim 1, wherein said plurality of abrasive segments provide a surface thickness of abrasive material directly attached to said core.

15. The segmented profiled grinding wheel of claim 1, wherein said plurality of abrasive segments are attached to said core by laser welding and/or metallic braze welding to help improve abrasive segment location precision and to provide a stronger bond.

16. The segmented profiled grinding wheel of claim 1, wherein said plurality of abrasive segments are attached to said core by adhering said segments to said core using adhesive.

17. The segmented profiled grinding wheel of claim 1, wherein said abrasive segments can be electrically conductive through said core by knurling at least one attachment surface that said abrasive segments are attached to with said adhesive, which contact said abrasive segments whereby continuity is made.

18. The segmented profiled grinding wheel of claim 1, wherein said plurality of abrasive segments further comprises an abrasive layer metallurgically attached to a backing layer, wherein said backing layer comprises a powdered metal bonding matrix with no diamond or diamond hardness abrasive grit mixed therein and said backing layer is attached to said core, wherein the powdered metal composition of said backing layer is substantially the same as the abrasive layer comprising said abrasive grit.

19. The segmented profiled grinding wheel of claim 1, wherein said plurality of abrasive segments further comprises an abrasive layer and a backing layer, wherein said backing layer is attached to said core by adhering said backing layer to said core using adhesive.

20. The segmented profiled grinding wheel of claim 1, wherein said plurality of abrasive segments are attached to said core by a method selected from the group consisting of laser welding, metallic braze welding, and combinations thereof and said plurality of abrasive segments are not additionally bonded to one another.

21. The segmented profiled grinding wheel of claim 1, wherein attaching said plurality of abrasive segments to said core further comprises attaching a bottom surface and opposing side surfaces of said plurality of abrasive segments to a bottom and opposing internal sides of a recess of said core, and wherein a top surface of said plurality of abrasive segments is located at a depth substantially flush with an opening of said recess.

22. A segmented profiled grinding wheel, comprising:

a core that is metal having a portion operable for attachment to a rotary power source;

radially extending first and second planar side portions;

a segmented abrasive portion attached to said core comprising a plurality of abrasive segments including terminal ends directly abutting against one another about said core substantially with no gaps therebetween, said plurality of abrasive segments including a powdered metal bonding matrix with sufficient diamond or diamond hardness abrasive grit mixed therein for grinding and a cutting surface profile extending along the longitudinal length of said abrasive segments;

wherein said plurality of abrasive segments are arcuate and said terminal ends are angled an operable amount to fit about said core; and wherein said cutting surface profiles align to form a substantially continuous rim of said abrasive segments with cutting surface profiles for substantially continuous contact with a workpiece while said wheel rotates;

wherein said plurality of abrasive segments are electrically conductive through said core by knurling at least one attachment surface that said abrasive segments are attached to creating peaks which contact said abrasive segments whereby continuity is made.

23. The segmented profiled grinding wheel of claim 22, wherein said plurality of abrasive segments further comprise a groove forming said cutting surface profile, wherein said cutting surface profile is U-shape.

24. The segmented profiled grinding wheel of claim 22, wherein said plurality of abrasive segments further comprise a groove forming said cutting surface profile, wherein said cutting surface profile is any shape.

25. The segmented profiled grinding wheel of claim 22, wherein said cutting surface profile is substantially flat.

26. The segmented profiled grinding wheel of claim 22, further comprising a peripheral surface that is substantially planar across its width and adjacent said first and second planar side portions, wherein said segmented abrasive portion is attached to said planar surface.

27. The segmented profiled grinding wheel of claim 22, further comprising a flange having a recess located on said first and/or second planar side portions, wherein said plurality of abrasive segments are attached within said recess, wherein at least a bottom surface of said abrasive segment is attached to a bottom of said recess.

28. The segmented profiled grinding wheel of claim 22, further comprising an outer circumferential surface having a substantially centered recess formed therein, wherein said plurality of abrasive segments are attached within said recess, wherein at least a bottom surface of said abrasive segment is attached to a bottom of said recess.

29. The segmented profiled grinding wheel of claim 22, wherein said plurality of abrasive segments provide a surface thickness of abrasive material directly attached to said core.

30. The segmented profiled grinding wheel of claim 22, wherein said plurality of abrasive segments are attached to said core by a method selected from the group consisting of laser welding, metallic braze welding, and combinations thereof to help provide a stronger bond, and said plurality of abrasive segments are not additionally bonded to one another.

31. The segmented profiled grinding wheel of claim 22, wherein said plurality of abrasive segments are attached to said metal core by adhering said segments to said core using adhesive.

32. The segmented profiled grinding wheel of claim 22, wherein said plurality of abrasive segments are attached to said metal core by adhering said segments to said core using an adhesive that is not water based.

33. The segmented profiled grinding wheel of claim 22, wherein said plurality of abrasive segments are attached to said core by adhering said segments to said core using adhesive, wherein said adhesive is electrical conductive adhesive.

34. The segmented profiled grinding wheel of claim 22, wherein said plurality of abrasive segments further comprises an abrasive layer attached to a backing layer, wherein said backing layer comprises a powdered metal bonding matrix with no diamond or diamond hardness abrasive grit mixed therein and said backing layer is attached to said core, wherein the powdered metal composition of said backing layer is substantially the same as the abrasive layer comprising said abrasive grit.

35. The segmented profiled grinding wheel of claim 22, wherein said plurality of abrasive segments further comprises an abrasive layer and a backing layer, wherein said backing layer is attached to said core by adhering said backing layer to said core using adhesive.

36. The segmented profiled grinding wheel of claim 22, wherein attaching said plurality of abrasive segments to said core further comprises attaching a bottom surface and opposing side surfaces of said plurality of abrasive segments to a bottom and opposing internal sides of a recess of said core, and wherein a top surface of said plurality of abrasive segments is located at a depth substantially flush with an opening of said recess.

37. A method of forming a segmented profiled grinding wheel, comprising:

forming a core that is metal having a hub portion with an arbor hole operable for attachment to a rotary power source and radially extending first and second planar side portions;

forming a plurality of abrasive segments including a powdered metal bonding matrix with sufficient diamond or diamond hardness abrasive grit mixed therein and a cutting service profile using substantially automated processing, wherein said plurality of abrasive segments include an arcuate shape and terminal ends; and bonding said plurality of abrasive segments to said core adjacent to one another by a process selected from the group consisting of laser welding, metallic brazing, overmolding, adhesive, and combinations thereof forming a segmented abrasive portion with aligned cutting surface profiles for substantially continuous contact with a workpiece while said wheel rotates; and further comprising the steps of adding metallic and/or conductive material filler to an adhesive to form an electrical conductive adhesive and adhering said segments to said core using said adhesive.

38. The method of forming the segmented profiled grinding wheel of claim 37, wherein forming said plurality of abrasive segments further includes steps using said automated processing, comprising:

mixing diamonds or diamond hardness material with a temporary binder and coating in metal powder to form a powdered metal bonding matrix grit material;

sintering said material an operable amount forming a sintered diamond bond for transporting to a mold cavity;

placing said material in a mold;

at least cold pressing said material in said mold;

sintering by heating said material at least once; and wherein said plurality of abrasive segments include said cutting surface profile and arcuate shape formed therein during said automated processing.

39. The method of forming the segmented profiled grinding wheel of claim 37, further comprising forming angles in said terminal ends during said automated processing for attaching said plurality of abrasive segments directly abutting against one another about said core.

40. The method of forming the segmented profiled grinding wheel of claim 37, wherein said plurality of abrasive segments are bonded to said core by adhering said segments to said core using an adhesive that is not water based.

41. The method of forming the segmented profiled grinding wheel of claim 37, further comprising knurling at least one attachment surface to create peaks to allow said plurality of abrasive segments to be electrically conductive through said core and coupling said abrasive segments to said at least one attachment surface whereby electrical continuity is made.

42. The method of forming the segmented profiled grinding wheel of claim 37, wherein forming said core is selected from the group consisting of machining, molding, cold forming, and combinations thereof.

43. The method of forming the segmented profiled grinding wheel of claim 37, wherein attaching said plurality of abrasive segments to said core further comprises attaching at least a bottom surface of said plurality of abrasive segments to at least a bottom of a recess formed in a flange extending from said first and/or second planar side portion.

44. The method of forming the segmented profiled grinding wheel of claim 37, wherein attaching said plurality of abrasive segments to said core further comprises attaching at least a bottom surface of said plurality of abrasive segments to at least a bottom of a substantially centered recess formed in an outer circumferential surface of said wheel.

45. The method of forming the segmented profiled grinding wheel of claim 37, wherein attaching said plurality of abrasive segments to said core further comprises attaching at least a bottom surface of said plurality of abrasive segments to a substantially planar peripheral surface of said wheel.

46. The method of forming the segmented profiled grinding wheel of claim 37, wherein attaching said plurality of abrasive segments to said core further comprises attaching a bottom surface and opposing side surfaces of said plurality of abrasive segments to a bottom and opposing internal sides of a recess of said core, and wherein a top surface of said plurality of abrasive segments is located at a depth substantially flush with an opening of said recess.

47. The method of forming the segmented profiled grinding wheel of claim 37, wherein forming said plurality of abrasive segments further comprises the steps, comprising, forming an abrasive layer and a backing layer, wherein said abrasive layer comprises said powdered metal bonding matrix with sufficient diamond or diamond hardness abrasive grit mixed therein;

attaching said abrasive layer to said backing layer, wherein said backing layer comprises a metal bonding matrix with no diamond or diamond hardness abrasive grit mixed therein; and attaching said backing layer to said core.

48. The method of forming the segmented profiled grinding wheel of claim 47, wherein said backing layer is attached to said core by adhering said backing layer to said core using adhesive.

* * * * *